US011475860B2

(12) United States Patent
Kitagawa et al.

(10) Patent No.: US 11,475,860 B2
(45) Date of Patent: Oct. 18, 2022

(54) LIQUID CRYSTAL DISPLAY WITH IN-CELL TOUCH PANEL PREVENTING DISPLAY DEFECT DURING TOUCH DETECTION

(71) Applicant: SHARP KABUSHIKI KAISHA, Sakai (JP)

(72) Inventors: Daiji Kitagawa, Sakai (JP); Jin Miyazawa, Sakai (JP); Yousuke Nakamura, Sakai (JP); Daisuke Suehiro, Sakai (JP); Noriyuki Tanaka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/528,107

(22) Filed: Nov. 16, 2021

(65) Prior Publication Data

US 2022/0189428 A1 Jun. 16, 2022

Related U.S. Application Data

(60) Provisional application No. 63/123,840, filed on Dec. 10, 2020.

(51) Int. Cl.
*G09G 3/36* (2006.01)

(52) U.S. Cl.
CPC ..... *G09G 3/3655* (2013.01); *G09G 3/3677* (2013.01); *G09G 3/3688* (2013.01); *G09G 2300/0842* (2013.01); *G09G 2310/0278* (2013.01)

(58) Field of Classification Search
CPC ..... G09G 3/36; G09G 3/3611; G09G 3/3648; G09G 3/3655; G09G 3/3674; G09G 3/3677; G09G 3/3681; G09G 3/3685; G09G 3/3688; G09G 3/3692; G09G 3/3696; G09G 2300/0842; G06G 3/041; G06G 3/0412;
(Continued)

(56) References Cited

U.S. PATENT DOCUMENTS 10,719,164 B2 * 7/2020 Takeuchi ..... G06F 3/0446
2011/0210927 A1 * 9/2011 Mizuhashi ..... G06F 3/0447 345/173

(Continued)

FOREIGN PATENT DOCUMENTS

JP 2015-096935 A 5/2015
JP 2017-083530 A 5/2017

OTHER PUBLICATIONS

Co-Pending letter regarding a related co-pending.

*Primary Examiner* — Alexander Eisen
*Assistant Examiner* — Nelson Lam
(74) *Attorney, Agent, or Firm* — ScienBiziP, P.C.

(57) ABSTRACT

A memory liquid crystal display including a liquid crystal panel with a built-in touch panel is provided with a state control circuit configured to switch a state of a pixel electrode between a floating state and a non-floating state. A pulse signal for touch detection is supplied to a common electrode in a touch detection period. The state control circuit changes the state of the pixel electrode from the non-floating state to the floating state before the start of the touch detection period, and changes the state of the pixel electrode from the floating state to the non-floating state after the end of the touch detection period.

6 Claims, 26 Drawing Sheets

(58) Field of Classification Search
CPC ..... G06G 3/044; G06G 3/045; G06G 3/046; G06G 3/047
USPC ..... 345/87–104, 173–179
See application file for complete search history.

(56) References Cited

U.S. PATENT DOCUMENTS

| | | | | |
|---|---|---|---|---|
| 2013/0021231 | A1* | 1/2013 | Kawashima | G02F 1/133555 345/98 |
| 2014/0111476 | A1* | 4/2014 | You | G09G 3/3655 345/174 |
| 2015/0097792 | A1 | 4/2015 | Yoshida | |
| 2016/0012789 | A1* | 1/2016 | Miyazawa | G09G 3/3648 345/96 |
| 2017/0115810 | A1 | 4/2017 | Takano | |
| 2017/0185221 | A1* | 6/2017 | Takeuchi | G06F 3/04184 |

* cited by examiner

| | Vbk | Vwh | Vp |
|---|---|---|---|
| BLACK DISPLAY | H | L | VA |
| WHITE DISPLAY | L | H | VB |
| TOUCH DETECTION | L | L | HIGH IMPEDANCE |

FIG. 13

--Related Art--

--Related Art--

--Related Art--

--Related Art--

--Related Art--

LIQUID CRYSTAL DISPLAY WITH IN-CELL TOUCH PANEL PREVENTING DISPLAY DEFECT DURING TOUCH DETECTION

CROSS-REFERENCE TO RELATED APPLICATIONS

This application claims the benefit of priority to U.S. Provisional Application No. 63/123,840 filed on Dec. 10, 2020. The entire contents of the above-identified application are hereby incorporated by reference.

BACKGROUND

Technical Field

The following disclosure relates to a liquid crystal display device and particularly relates to a liquid crystal display device including a liquid crystal panel with a built-in touch panel.

A touch panel has attracted attention as an input device for performing operations in a computer system or the like in the related art. For example, in a capacitive touch panel, a position of an object to be detected such as a finger of a user (operator) or a touch pen is detected based on a change in electrostatic capacitance. Such a touch panel has been used by being superimposed on a display panel such as a liquid crystal panel in the related art. Such a touch panel provided on the display panel is referred to as an "out-cell type touch panel".

However, in the out-cell type touch panel, an increase in the weight and the thickness of the entire device including the display panel and the touch panel, and an increase in the power required to drive the touch panel have been problems. Thus, in recent years, development of display devices having a configuration in which the display panel and the touch panel are integrated has advanced. The touch panels having the configuration integrated with the display panel mainly include those referred to as "on-cell type touch panels" and those referred to as "in-cell type touch panels". In the on-cell type touch panels, a sensor electrode is provided between one of two glass substrates constituting the display panel and a polarizer. In the in-cell type touch panels, the sensor electrode is provided inside the two glass substrates.

As described above, the touch panels include several types, but in recent years, the in-cell type touch panels have become mainstream in the market. In the in-cell type touch panels, rectangular sensor electrodes segmented into a plurality of rows×a plurality of columns are typically used, and touch detection (detection of touch position on the touch panel) is performed by a self capacitance method. Note that the self capacitance method is a method for measuring a position of an object to be detected by detecting that electrostatic capacitance has increased due to contact or approach of the object to be detected with or to the touch panel.

Some in-cell type touch panels employ a configuration in which the sensor electrode described above and a common electrode which is an electrode used for displaying an image are shared. In such a configuration, one electrode is used as the sensor electrode for performing the touch detection, and is also used as the common electrode for image display. By sharing the sensor electrode and the common electrode in this manner, a reduction in thickness and weight of the device are realized.

In recent years, liquid crystal display devices provided with memory circuits in pixel circuits have been developed in order to reduce power consumption. Such a liquid crystal display device is referred to as a "memory liquid crystal display". In general, in the memory liquid crystal display, one bit of data can be held for each pixel, and in a case where an image of the same content or an image with a small change is displayed for a long period of time, image display using the data held in the memory circuit is performed. In the memory liquid crystal display, once the data is written to the memory circuit, the contents of the data written to the memory circuit are held until the next rewrite. Thus, little power is consumed in periods other than the periods before and after the contents of the image change. Thus, low power consumption can be achieved.

FIG. 22 is a diagram illustrating a configuration of a pixel circuit 900 of a known memory liquid crystal display. As illustrated in FIG. 22, the pixel circuit 900 includes an input switch 910, a memory circuit 920, a voltage selection circuit 930, and a liquid crystal capacitance 940 constituted by a pixel electrode 941 and a common electrode 942. A first scanning signal GLA, a second scanning signal GLB, a data signal SL, a black voltage VA, which is a voltage for black display, and a white voltage VB, which is a voltage for white display, are supplied to the pixel circuit 900.

A state of the input switch 910 is controlled by the first scanning signal GLA and the second scanning signal GLB. When the input switch 910 is in an on state, the data signal SL is supplied to the memory circuit 920. Note that the data signal SL is binary data. The memory circuit 920 stores the binary data based on the data signal SL. The voltage selection circuit 930 selects either the black voltage VA or the white voltage VB in accordance with a value of the binary data stored in the memory circuit 920. The voltage selected by the voltage selection circuit 930 is then applied to the pixel electrode 941, which is reflected in a display state of the pixel.

Note that, in connection with the present case, JP 2015-96935 A and JP 2017-83530 A disclose technologies related to a memory liquid crystal display provided with a touch panel.

However, the memory liquid crystal display provided with the in-cell type touch panel is not realized for the reasons below. Note that in the following, a common electrode voltage is denoted by a reference sign VCOM, and a pixel electrode voltage is denoted by a reference sign Vp. In the following, focusing on a normally-white type, it is assumed that a liquid crystal application voltage is 0 V when the white display is performed, and the liquid crystal application voltage is 5 V or −5 V when the black display is performed.

FIG. 23 is a waveform diagram when the black display is performed by a known memory liquid crystal display (by one pixel of interest). For the common electrode voltage VCOM, 5 V and 0 V appear alternately. Specifically, the common electrode voltage VCOM is 5 V in a period in which the black voltage VA is 0 V, and the common electrode voltage VCOM is 0 V in a period in which the black voltage VA is 5 V. By selecting the black voltage VA by the voltage selection circuit 930, the pixel electrode voltage Vp is equal to the black voltage VA. As described above, the liquid crystal application voltage is −5 V in a period in which the common electrode voltage VCOM is 5 V, and the liquid crystal application voltage is 5 V in a period in which the common electrode voltage VCOM is 0 V. As a result, the black display is performed.

FIG. 24 is a waveform diagram when the black display is performed, assuming that the known memory liquid crystal display is provided with the in-cell type touch panel. Note that a touch detection period (a period for detecting a touched position on the touch panel) is denoted by a reference sign Td. A pulse signal for touch detection is supplied to the common electrode 942 in the touch detection period Td. Accordingly, in the touch detection period Td, as illustrated in FIG. 24, the common electrode voltage VCOM varies between 0 V and 5 V. Here, in a period in which the common electrode voltage VCOM is 0 V among periods T91 and T93 in which the common electrode voltage VCOM is supposed to be maintained at 5 V, the common electrode voltage VCOM and the pixel electrode voltage Vp are equal to each other, so the liquid crystal application voltage is 0 V. In addition, in a period in which the common electrode voltage VCOM is 5 V among periods T92 and T94 in which the common electrode voltage VCOM is supposed to be maintained at 0 V, the common electrode voltage VCOM and the pixel electrode voltage Vp are also equal to each other, so the liquid crystal application voltage is 0 V. In this way, the white display is inserted in the period in which the black display is supposed to be performed.

FIG. 25 is a waveform diagram when the white display is performed by the known memory liquid crystal display. For the common electrode voltage VCOM, 5 V and 0 V appear alternately. Specifically, the common electrode voltage VCOM is 5 V in a period in which the white voltage VB is 5 V, and the common electrode voltage VCOM is 0 V in a period in which the white voltage VB is 0 V. By selecting the white voltage VB in the voltage selection circuit 930, the pixel electrode voltage Vp is equal to the white voltage VB. As described above, the liquid crystal application voltage is 0 V both in the period in which the common electrode voltage VCOM is 5 V and in the period in which the common electrode voltage VCOM is 0 V. As a result, the white display is performed.

FIG. 26 is a waveform diagram when the white display is performed, assuming that the known memory liquid crystal display is provided with the in-cell type touch panel. Similar to the example illustrated in FIG. 24, in the touch detection period Td, as illustrated in FIG. 26, the common electrode voltage VCOM varies between 0 V and 5 V. Here, in a period in which the common electrode voltage VCOM is 0 V among periods T95 and T97 in which the common electrode voltage VCOM is supposed to be maintained at 5 V, the pixel electrode voltage Vp is maintained at 5 V, so the liquid crystal application voltage is 5 V. In addition, in a period in which the common electrode voltage VCOM is 5 V among periods T96 and T98 in which the common electrode voltage VCOM is supposed to be maintained at 0 V, the pixel electrode voltage Vp is maintained at 0 V, so the liquid crystal application voltage is −5 V. In this way, the black display is inserted in the period in which the white display is supposed to be performed.

As described above, in the case where the in-cell type touch panel is provided in the known memory liquid crystal display, a display defect (inversion of black and white) occurs due to the pulse signal for touch detection being supplied to the common electrode 942.

SUMMARY

Thus, the following disclosure is directed to realizing the memory liquid crystal display provided with the in-cell type touch panel.

(1) A liquid crystal display device according to some embodiments of the disclosure is a liquid crystal display device including a liquid crystal panel with a built-in touch panel, the liquid crystal display device including a plurality of pixel circuits each including a liquid crystal capacitance constituted by a pixel electrode and a common electrode, a memory circuit configured to store binary data, and a voltage selection circuit configured to supply either a first voltage or a second voltage to the pixel electrode in accordance with a value of the binary data stored in the memory circuit; a common electrode drive circuit configured to drive the common electrode; and a state control circuit configured to switch a state of the pixel electrode between a floating state and a non-floating state, wherein the touch panel uses the common electrode as an electrode for touch detection, the common electrode drive circuit supplies a pulse signal for touch detection to the common electrode in a touch detection period for detecting a touched position on the touch panel, and the state control circuit switches the state of the pixel electrode from the non-floating state to the floating state before a start of the touch detection period, and switches the state of the pixel electrode from the floating state to the non-floating state after an end of the touch detection period.

According to such a configuration, even when the pulse signal for touch detection is supplied to the common electrode in the touch detection period in the memory liquid crystal display, the pixel electrode voltage also changes in accordance with the change in the common electrode voltage. Thus, the liquid crystal application voltage is maintained at the desired voltage throughout the touch detection period. Thus, the display defect (inversion of black and white) due to the pulse signal for touch detection being supplied to the common electrode does not occur. As described above, the memory liquid crystal display provided with the in-cell type touch panel is realized.

(2) The liquid crystal display device according to some embodiments of the disclosure includes the above-described configuration (1), wherein the state control circuit is a switch circuit provided between the voltage selection circuit and the pixel electrode, and the switch circuit electrically disconnects the voltage selection circuit and the pixel electrode from each other before the start of the touch detection period, and electrically connects the voltage selection circuit and the pixel electrode to each other after the end of the touch detection period.

(3) The liquid crystal display device according to some embodiments of the disclosure includes, in addition to the above-described configuration (2), a plurality of scanning signal lines configured to supply a scanning signal to each of the plurality of pixel circuits; a scanning signal line drive circuit configured to apply the scanning signal to each of the plurality of scanning signal lines; a plurality of data signal lines configured to supply a data signal to each of the plurality of pixel circuits; a data signal line drive circuit configured to apply the data signal to each of the plurality of data signal lines; a plurality of first voltage supply wiring lines configured to supply the first voltage to each of the plurality of pixel circuits; a plurality of second voltage supply wiring lines configured to supply the second voltage to each of the plurality of pixel circuits; a display voltage generation circuit configured to generate the first voltage and the second voltage; a scanning signal supply control switch circuit provided in a region outside a display region where the plurality of pixel circuits are formed, the scanning signal supply control switch circuit being configured to control an electrical connection state between the scanning signal line drive circuit and the plurality of scanning signal lines in the display region; a data signal supply control switch circuit provided in the region outside the display region, the data signal supply control switch circuit being configured to control an electrical connection state between the data signal line drive circuit and the plurality of data signal lines in the display region; and a display voltage supply control switch circuit provided in the region outside the display region, the display voltage supply control switch circuit being configured to control an electrical connection state between the display voltage generation circuit and the plurality of first voltage supply wiring lines in the display region and an electrical connection state between the display voltage generation circuit and the plurality of second voltage supply wiring lines in the display region, wherein the scanning signal supply control switch circuit electrically disconnects the scanning signal line drive circuit and the plurality of scanning signal lines in the display region from each other before the start of the touch detection period, and electrically connects the scanning signal line drive circuit and the plurality of scanning signal lines in the display region to each other after the end of the touch detection period, the data signal supply control switch circuit electrically disconnects the data signal line drive circuit and the plurality of data signal lines in the display region from each other before the start of the touch detection period, and electrically connects the data signal line drive circuit and the plurality of data signal lines in the display region to each other after the end of the touch detection period, and the display voltage supply control switch circuit electrically disconnects the display voltage generation circuit and the plurality of first voltage supply wiring lines in the display region from each other and electrically disconnects the display voltage generation circuit and the plurality of second voltage supply wiring lines in the display region from each other before the start of the touch detection period, and electrically connects the display voltage generation circuit and the plurality of first voltage supply wiring lines in the display region to each other and electrically connects the display voltage generation circuit and the plurality of second voltage supply wiring lines in the display region to each other after the end of the touch detection period.

(4) The liquid crystal display device according to some embodiments of the disclosure includes the above-described configuration (1), wherein the voltage selection circuit includes a first voltage supply control switch circuit configured to control an electrical connection state between a first voltage supply wiring line configured to supply the first voltage and the pixel electrode, and a second voltage supply control switch circuit configured to control an electrical connection state between a second voltage supply wiring line configured to supply the second voltage and the pixel electrode, the first voltage supply control switch circuit electrically connects the first voltage supply wiring line and the pixel electrode to each other when a first voltage supply control signal provided from the memory circuit is at an on level, and electrically disconnects the first voltage supply wiring line and the pixel electrode from each other when the first voltage supply control signal is at an off level, the second voltage supply control switch circuit electrically connects the second voltage supply wiring line and the pixel electrode to each other when a second voltage supply control signal provided from the memory circuit is at the on level, and electrically disconnects the second voltage supply wiring line and the pixel electrode from each other when the second voltage supply control signal is at the off level, and the state control circuit is a switching circuit provided in the memory circuit and configured to switch a level of the first voltage supply control signal between the on level and the off level and switch a level of the second voltage supply control signal between the on level and the off level, the switching circuit maintaining the level of the first voltage supply control signal and the level of the second voltage supply control signal at the off level in the touch detection period.

(5) The liquid crystal display device according to some embodiments of the disclosure includes, in addition to the above-described configuration (4), a plurality of scanning signal lines configured to supply a scanning signal to each of the plurality of pixel circuits; a scanning signal line drive circuit configured to apply the scanning signal to each of the plurality of scanning signal lines; a plurality of data signal lines configured to supply a data signal to each of the plurality of pixel circuits; a data signal line drive circuit configured to apply the data signal to each of the plurality of data signal lines; a display voltage generation circuit configured to generate the first voltage and the second voltage; a scanning signal supply control switch circuit provided in a region outside a display region where the plurality of pixel circuits are formed, the scanning signal supply control switch circuit being configured to control an electrical connection state between the scanning signal line drive circuit and the plurality of scanning signal lines in the display region; a data signal supply control switch circuit provided in the region outside the display region, the data signal supply control switch circuit being configured to control an electrical connection state between the data signal line drive circuit and the plurality of data signal lines in the display region; and a display voltage supply control switch circuit provided in the region outside the display region, the display voltage supply control switch circuit being configured to control an electrical connection state between the display voltage generation circuit and the plurality of first voltage supply wiring lines in the display region and an electrical connection state between the display voltage generation circuit and the plurality of second voltage supply wiring lines in the display region, wherein the scanning signal supply control switch circuit electrically disconnects the scanning signal line drive circuit and the plurality of scanning signal lines in the display region from each other before the start of the touch detection period, and electrically connects the scanning signal line drive circuit and the plurality of scanning signal lines in the display region to each other after the end of the touch detection period, the data signal supply control switch circuit electrically disconnects the data signal line drive circuit and the plurality of data signal lines in the display region from each other before the start of the touch detection period, and electrically connects the data signal line drive circuit and the plurality of data signal lines in the display region to each other after the end of the touch detection period, and the display voltage supply control switch circuit electrically disconnects the display voltage generation circuit and the plurality of first voltage supply wiring lines in the display region from each other and electrically disconnects the display voltage generation circuit and the plurality of second voltage supply wiring lines in the display region from each other before the start of the touch detection period, and electrically connects the display voltage generation circuit and the plurality of first voltage supply wiring lines in the display region to each other and electrically connects the display voltage generation circuit and the plurality of second voltage supply wiring lines in the display region to each other after the end of the touch detection period.

(6) The liquid crystal display device according to some embodiments of the disclosure includes, in addition to the above-described configuration (1), a display voltage generation circuit provided outside the liquid crystal panel, the display voltage generation circuit being configured to generate the first voltage and the second voltage; a first voltage supply wiring line configured to supply the first voltage from the display voltage generation circuit to the voltage selection circuit; and a second voltage supply wiring line configured to supply the second voltage from the display voltage generation circuit to the voltage selection circuit, wherein the state control circuit is a switch circuit provided between the display voltage generation circuit and the first voltage supply wiring line and between the display voltage generation circuit and the second voltage supply wiring line, the switch circuit being configured to electrically disconnect the display voltage generation circuit and the first voltage supply wiring line from each other and electrically disconnect the display voltage generation circuit and the second voltage supply wiring line from each other before the start of the touch detection period, and electrically connect the display voltage generation circuit and the first voltage supply wiring line to each other and electrically connect the display voltage generation circuit and the second voltage supply wiring line to each other after the end of the touch detection period.

(7) A liquid crystal display device according to some embodiments of the disclosure includes, in addition to the above-described configuration (6), a plurality of scanning signal lines configured to supply a scanning signal to each of the plurality of pixel circuits; a scanning signal line drive circuit configured to apply the scanning signal to each of the plurality of scanning signal lines; a plurality of data signal lines configured to supply a data signal to each of the plurality of pixel circuits; a data signal line drive circuit configured to apply the data signal to each of the plurality of data signal lines; a scanning signal supply control switch circuit provided in a region outside a display region where the plurality of pixel circuits are formed, the scanning signal supply control switch circuit being configured to control an electrical connection state between the scanning signal line drive circuit and the plurality of scanning signal lines in the display region; and a data signal supply control switch circuit provided in the region outside the display region, the data signal supply control switch circuit being configured to control an electrical connection state between the data signal line drive circuit and the plurality of data signal lines in the display region, wherein the scanning signal supply control switch circuit electrically disconnects the scanning signal line drive circuit and the plurality of scanning signal lines in the display region from each other before the start of the touch detection period and electrically connects the scanning signal line drive circuit and the plurality of scanning signal lines in the display region to each other after the end of the touch detection period, and the data signal supply control switch circuit electrically disconnects the data signal line drive circuit and the plurality of data signal lines in the display region from each other before the start of the touch detection period and electrically connects the data signal line drive circuit and the plurality of data signal lines in the display region to each other after the end of the touch detection period.

(8) A liquid crystal display device according to some embodiments of the disclosure includes the above-described configuration (6), wherein the display voltage generation circuit and the switch circuit are provided in one integrated circuit.

(9) A liquid crystal display device according to several embodiments of the disclosure includes any one of the above-described configurations (1) to (8), wherein each of the plurality of pixel circuits includes auxiliary capacitance provided in parallel to the liquid crystal capacitance.

(10) A method for driving a liquid crystal display device according to some embodiments of the disclosure is a method for driving a liquid crystal display device including a liquid crystal panel with a built-in touch panel, the liquid crystal display device including a plurality of pixel circuits each including a liquid crystal capacitance constituted by a pixel electrode and a common electrode, a memory circuit configured to store binary data, and a voltage selection circuit configured to supply either a first voltage or a second voltage to the pixel electrode in accordance with a value of the binary data stored in the memory circuit; and a common electrode drive circuit configured to drive the common electrode, the touch panel using the common electrode as an electrode for touch detection, the method sequentially executing: a step of switching a state of the pixel electrode from a non-floating state to a floating state; a step of supplying, by the common electrode drive circuit, a pulse signal for touch detection to the common electrode to detect a touched position on the touch panel; and a step of switching the state of the pixel electrode from the floating state to the non-floating state.

These and other objects, features, aspects, and advantages of the disclosure will become more apparent from the following detailed description of the disclosure with reference to the accompanying drawings.

BRIEF DESCRIPTION OF DRAWINGS

The disclosure will be described with reference to the accompanying drawings, wherein like numbers reference like elements.

FIG. 13 is a truth table of a black voltage supply control signal and a white voltage supply control signal in the second embodiment.

DESCRIPTION OF EMBODIMENTS

Embodiments will be described below with reference to the accompanying drawings. A liquid crystal display device described in each of the following embodiments is above-described memory liquid crystal display. and includes the in-cell type touch panel.

1. First Embodiment

1.1 Overall Configuration and Schematic Operation

Figure 2:
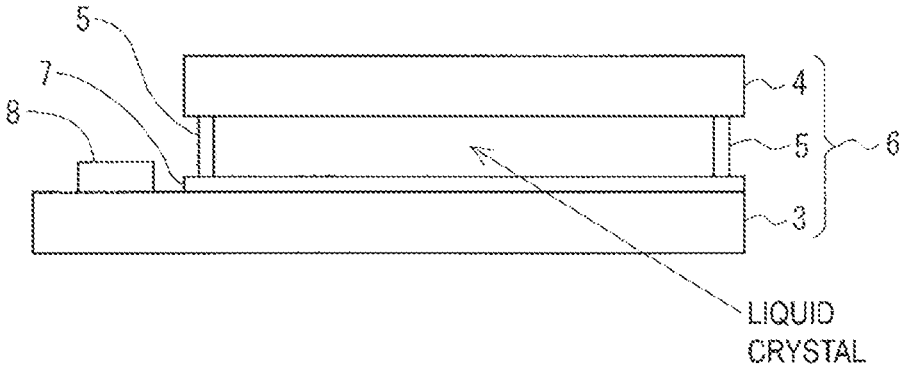
FIG. 2 is a schematic side view of a liquid crystal display device according the first embodiment.

An overall configuration and a schematic operation of the liquid crystal display device according to the first embodiment will be described with reference to FIGS. 2 to 5. FIG. 2 is a schematic side view of the liquid crystal display device according the present embodiment. In the present embodiment, a liquid crystal panel 6 is constituted of a TFT array substrate 3 and a color filter substrate 4, which are two glass substrates provided to face each other with a liquid crystal interposed therebetween. The TFT array substrate 3 and the color filter substrate 4 are bonded together by, for example, a sealing member 5. A touch panel 7 is built in the liquid crystal panel 6. In other words, the touch panel 7 in the present embodiment is the in-cell type touch panel. An IC 8, referred to as a Touch and Display Driver Integration (TDDI), is provided in a so-called frame region on the TFT array substrate 3. The IC 8 has a function of controlling image display and a function of controlling touch detection.

In the present embodiment, a common electrode, which is an electrode for image display, is also used as an electrode for touch detection. By sharing the electrode for touch detection and the electrode for image display in this manner, a reduction in thickness and weight of the device is realized.

In the present embodiment, both of the pixel electrode and the common electrode are provided on the TFT array substrate 3. In other words, the IPS mode is employed as the liquid crystal operating mode. However, no such limitation is intended.

Figure 3:
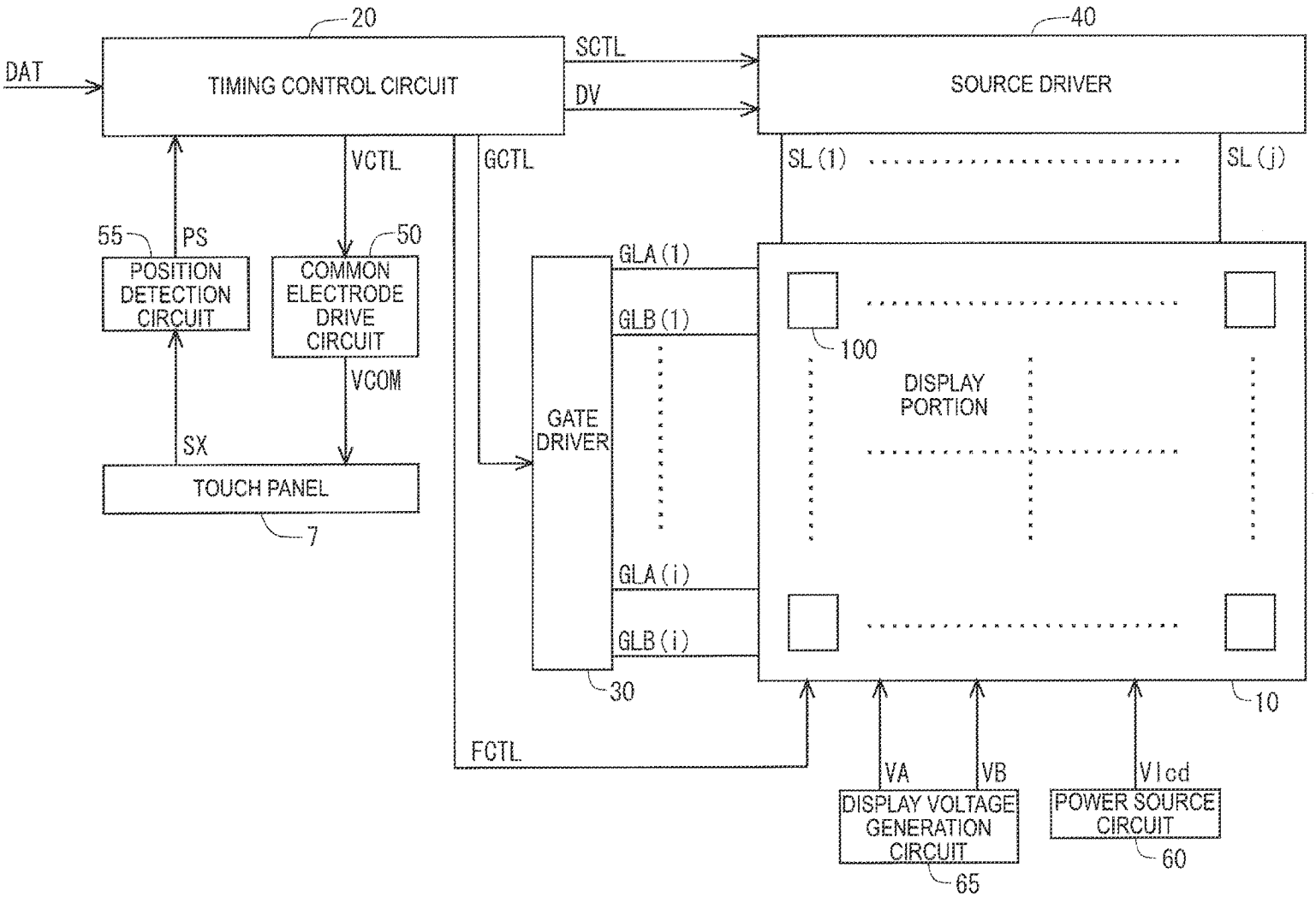
FIG. 3 is a block diagram for describing a functional configuration of the liquid crystal display device according to the first embodiment.

FIG. 3 is a block diagram for describing a functional configuration of the liquid crystal display device according to the present embodiment. As illustrated in FIG. 3, the liquid crystal display device includes a display portion 10, the touch panel 7 a timing control circuit 20, a gate driver (scanning signal line drive circuit) 30, a source driver (data signal line drive circuit) 40, a common electrode drive circuit 50, a position detection circuit 55, a power source circuit 60, and a display voltage generation circuit 65. The display portion (display region) 10 includes (i×j) pixel circuits 100. The touch panel 7 is constituted by the common electrode. Note that the timing control circuit 20, the source driver 40, the common electrode drive circuit 50, the position detection circuit 55, the power source circuit 60, and the display voltage generation circuit 65 are provided in the above-described IC 8 (see FIG. 2).

Figure 4:
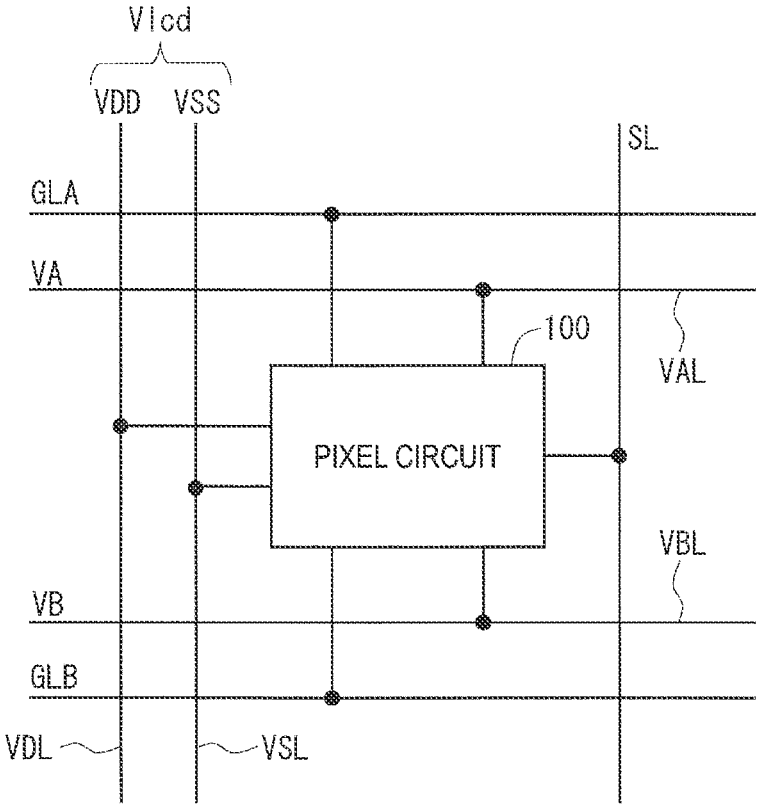
FIG. 4 is a diagram for describing various wiring lines arranged around the pixel circuit according to the first embodiment.

Various wiring lines are arranged around each pixel circuit 100 as illustrated in FIG. 4. Specifically, each pixel circuit 100 is connected to a first gate bus line configured to supply a first scanning signal GLA, a second gate bus line configured to supply a second scanning signal GLB, a source bus line configured to supply a data signal SL, a black voltage supply line VAL configured to supply the black voltage VA, a white voltage supply line VBL configured to supply the white voltage VB, a high-level voltage supply line VDL configured to supply a high-level DC power supply voltage VDD, and a low-level voltage supply line VSL configured to supply a low-level DC power supply voltage VSS. Accordingly, a plurality of the first gate bus lines, a plurality of the second gate bus lines, a plurality of the source bus lines, a plurality of the black voltage supply lines VAL, a plurality of the white voltage supply lines VBL, a plurality of the high-level voltage supply lines VDL, and a plurality of the low-level voltage supply lines VSL are arranged in the display portion 10. Note that the first gate bus line and the second gate bus line correspond to a scanning signal line, the source bus line corresponds to a data signal line, the black voltage supply line VAL corresponds to a first voltage supply wiring line, the white voltage supply line VBL corresponds to a second voltage supply wiring line, the black voltage VA corresponds to a first voltage, and the white voltage VB corresponds to a second voltage.

The timing control circuit 20 receives image data DAT transmitted from an external host or the like and outputs a digital video signal DV, a gate control signal GCTL for controlling an operation of the gate driver 30, a source control signal SCTL for controlling an operation of the source driver 40, and a common electrode control signal VCTL for controlling an operation of the common electrode drive circuit 50. The gate control signal GCTL includes a gate start pulse signal, a gate clock signal, and the like. The source control signal SCTL includes a source start pulse signal, a source clock signal, a latch strobe signal, and the like. Note that a floating control signal FCTL, which will be described later, is also output from the timing control circuit 20.

The gate driver 30 applies the first scanning signals GLA(1) to GLA(i) to the i first gate bus lines, and applies the second scanning signals GLB(1) to GLB(i) to the i second gate bus lines, based on the gate control signal GCTL transmitted from the timing control circuit 20. The source driver 40 applies data signals SL(1) to SL(j) to the j source bus lines, based on the digital video signal DV and the source control signal SCTL transmitted from the timing control circuit 20. The common electrode drive circuit 50 applies the common electrode voltage VCOM to the common electrode constituting the touch panel 7 based on the common electrode control signal VCTL transmitted from the timing control circuit 20. Note that a pulse signal for touch detection is supplied to the common electrode in a touch detection period. The position detection circuit 55 receives the detection signal SX as a result of the touch detection, and supplies a position signal PS indicating a touch position to the timing control circuit 20. As a result, in the liquid crystal display device, image display in accordance with the touch position is performed.

The power source circuit 60 outputs a power supply voltage Vlcd (high-level DC power supply voltage VDD and low-level DC power supply voltage VSS) for holding data in the memory circuit in the pixel circuit 100. The display voltage generation circuit 65 generates and outputs the black voltage VA and the white voltage VB.

Figure 5:
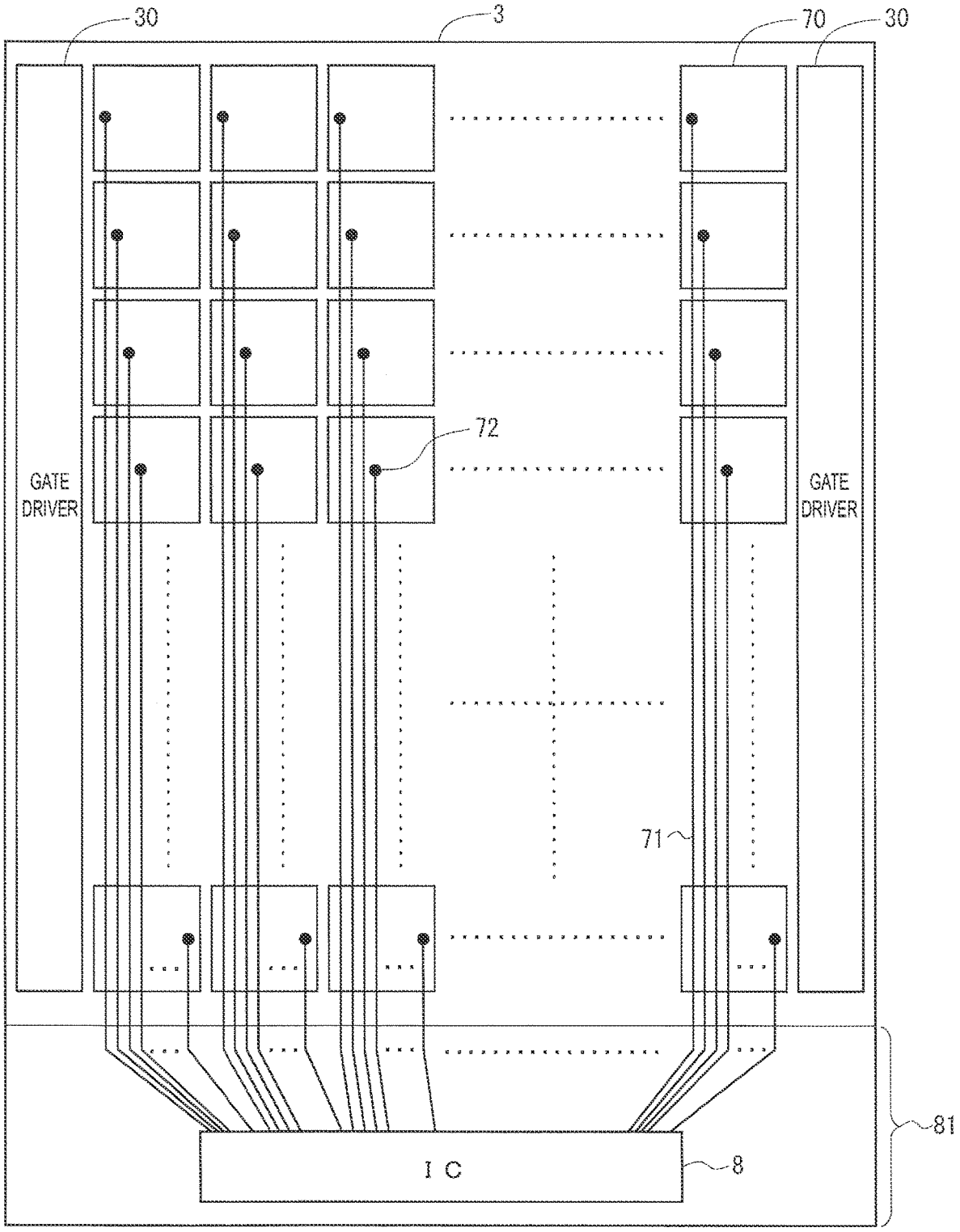
FIG. 5 is a schematic plan view illustrating a schematic configuration for touch detection in the first embodiment.

FIG. 5 is a plan view illustrating a schematic configuration for the touch detection. As described above, the liquid crystal panel 6 is constituted by the TFT array substrate 3 and the color filter substrate 4, which are two glass substrates provided to face each other with the liquid crystal interposed therebetween. Components for the touch detection are provided on the TFT array substrate 3 of the two glass substrates. Specifically, a common electrode 70, a common electrode wiring line 71, and the IC 8 are provided on the TFT array substrate 3. A contact portion 72 for connecting the common electrode 70 and the common electrode wiring line 71 to each other is provided on the TFT array substrate 3. Note that the IC 8 is provided in a frame region 81.

The common electrode 70 is realized by a transparent conductive film such as Indium Tin Oxide (ITO). As illustrated in FIG. 5, the common electrode 70 is divided into rectangular pads having a plurality of rows×a plurality of columns (for example, 32 rows×18 columns). In the present embodiment, the common electrode (each pad) 70 divided in this manner is used as an electrode for touch detection. In this regard, one pad is a minimum unit for detecting a position. Note that the number of divisions of the common electrode 70 is not particularly limited, and may be divided in accordance with a target resolution.

One end of the common electrode wiring line 71 is connected to the contact portion 72 formed on the corresponding common electrode 70, and the other end of the common electrode wiring line 71 is connected to the IC 8. As a result, the common electrode voltage VCOM is supplied to each common electrode 70 from the IC 8, and the touch position can be identified based on the detection signal SX.

1.2 Pixel Circuit

Figure 1:
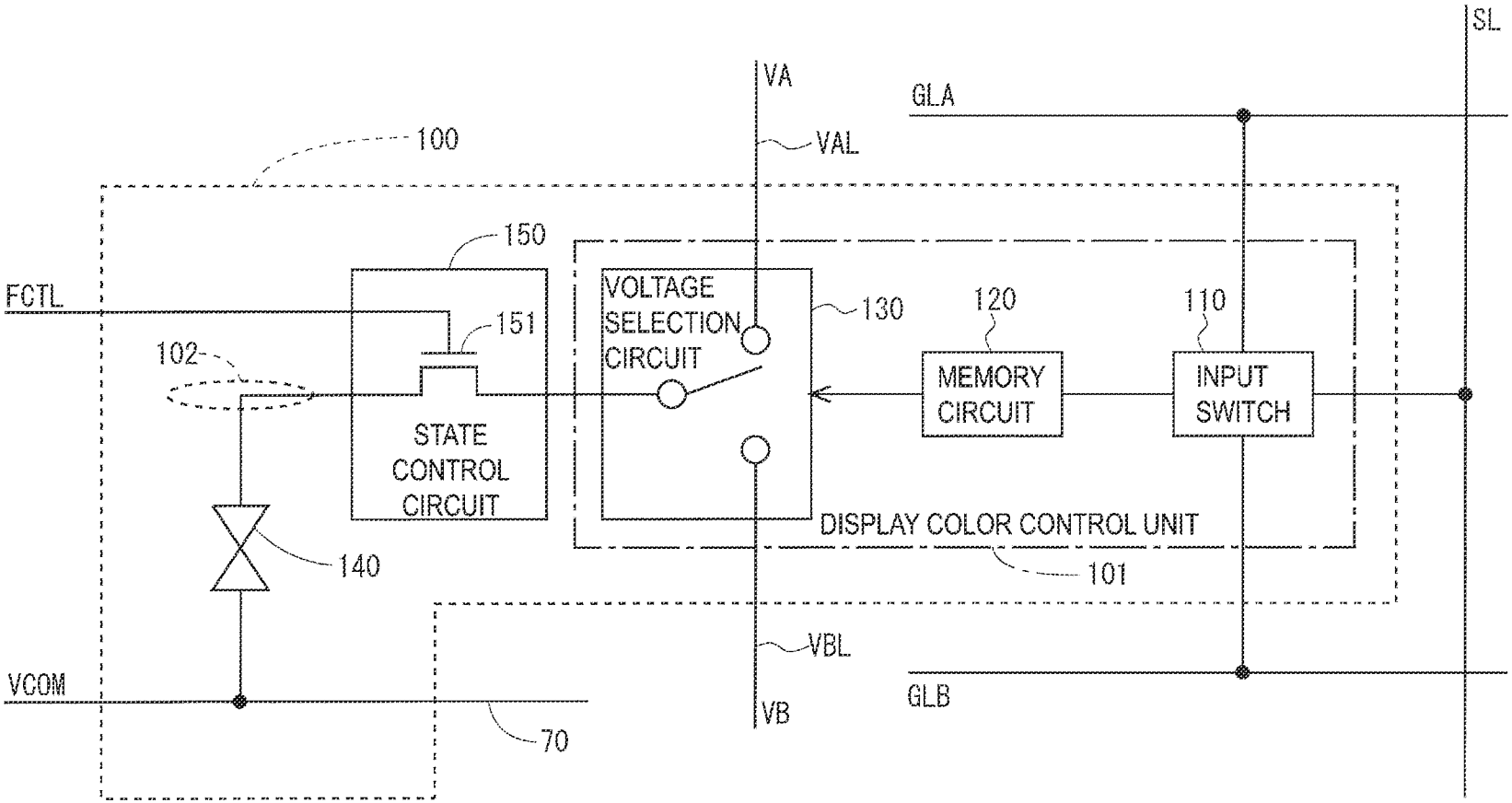
FIG. 1 is a diagram illustrating a schematic configuration of a pixel circuit in a first embodiment.
Figure 22:
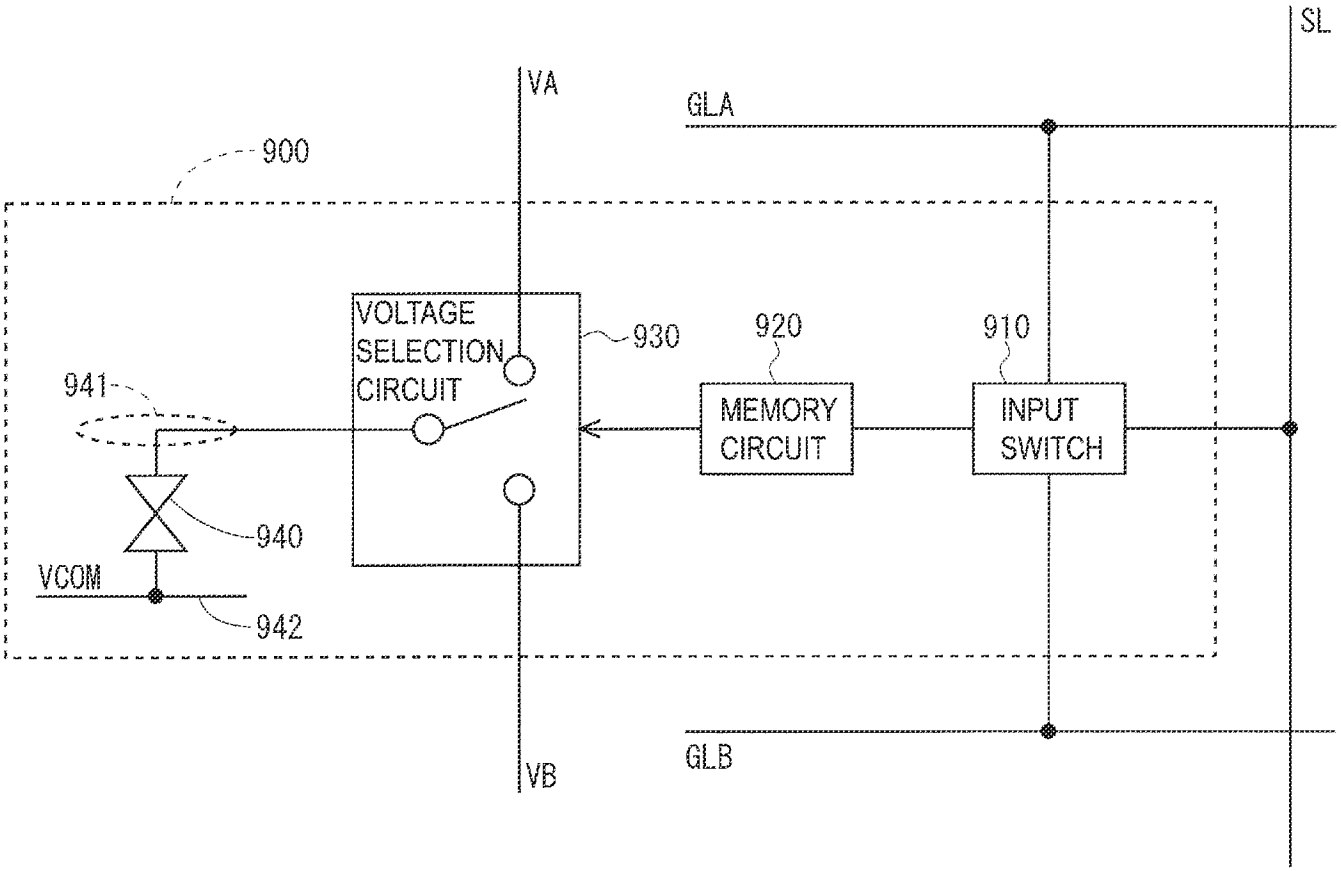
FIG. 22 is a diagram illustrating a configuration of a pixel circuit of a known memory liquid crystal display.
Figure 23:
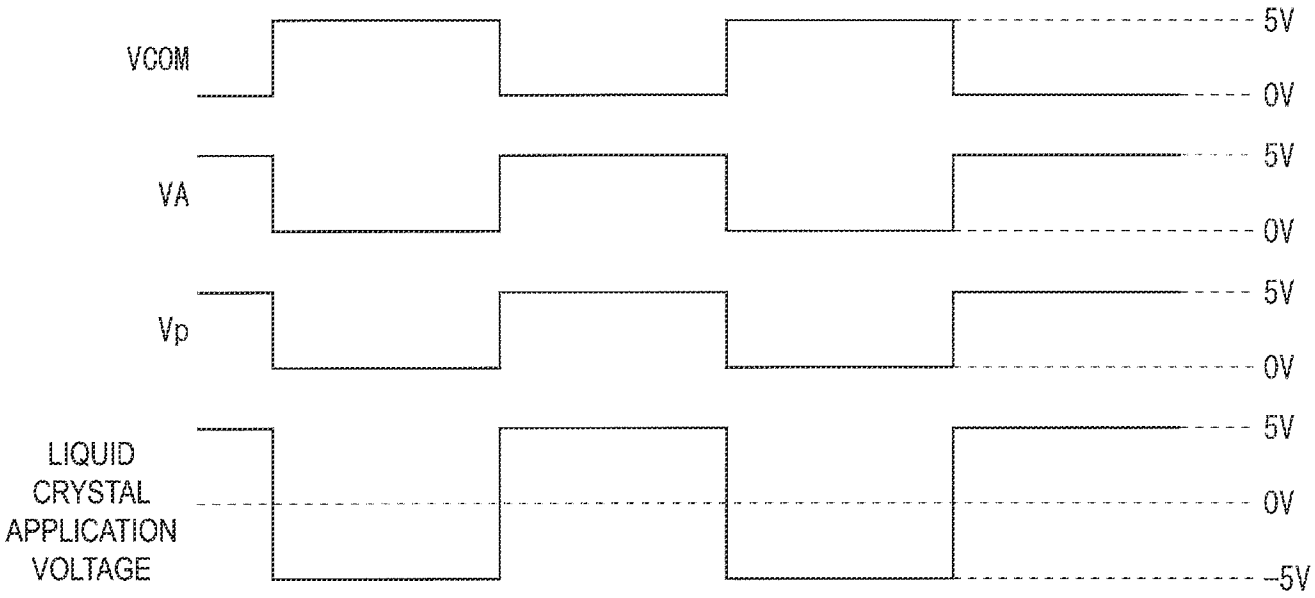
FIG. 23 is a waveform diagram when the black display is performed by the known memory liquid crystal display.
Figure 24:
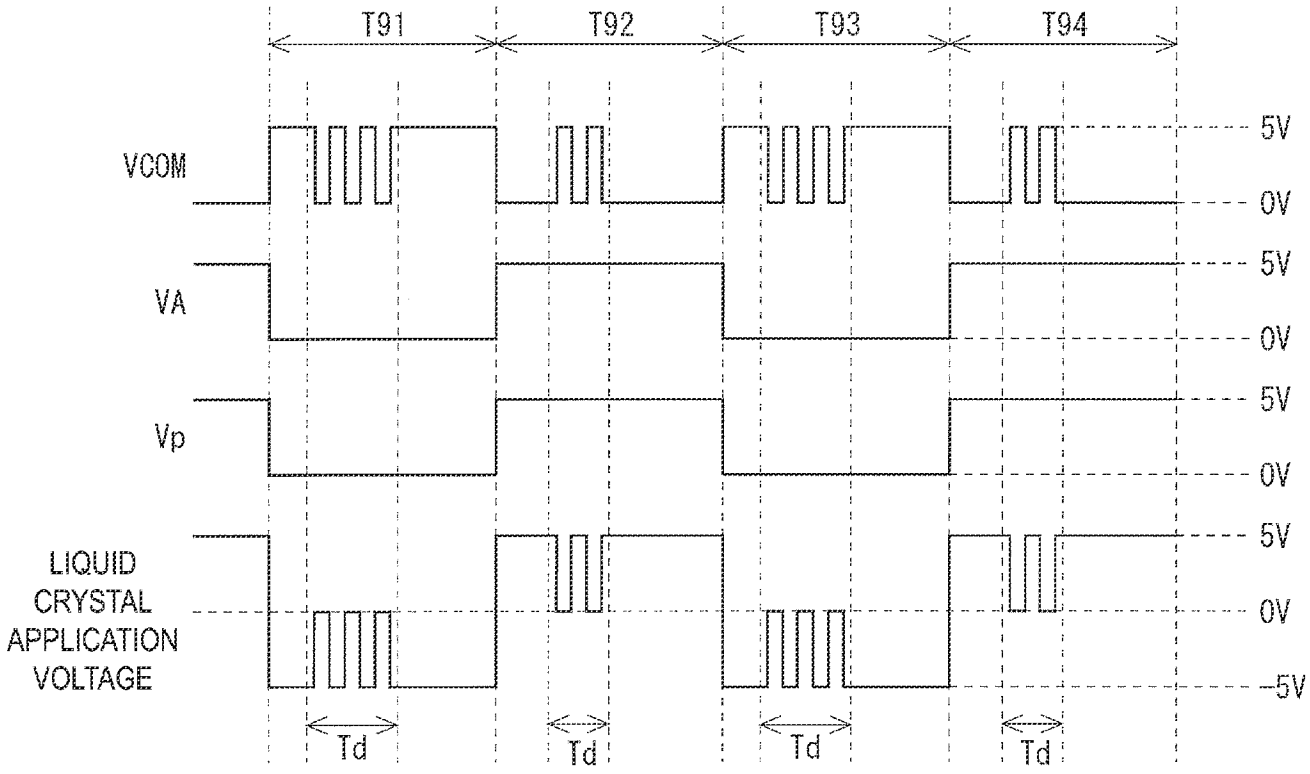
FIG. 24 is a waveform diagram when the black display is performed, assuming that the known memory liquid crystal display is provided with the in-cell type touch panel.
Figure 25:
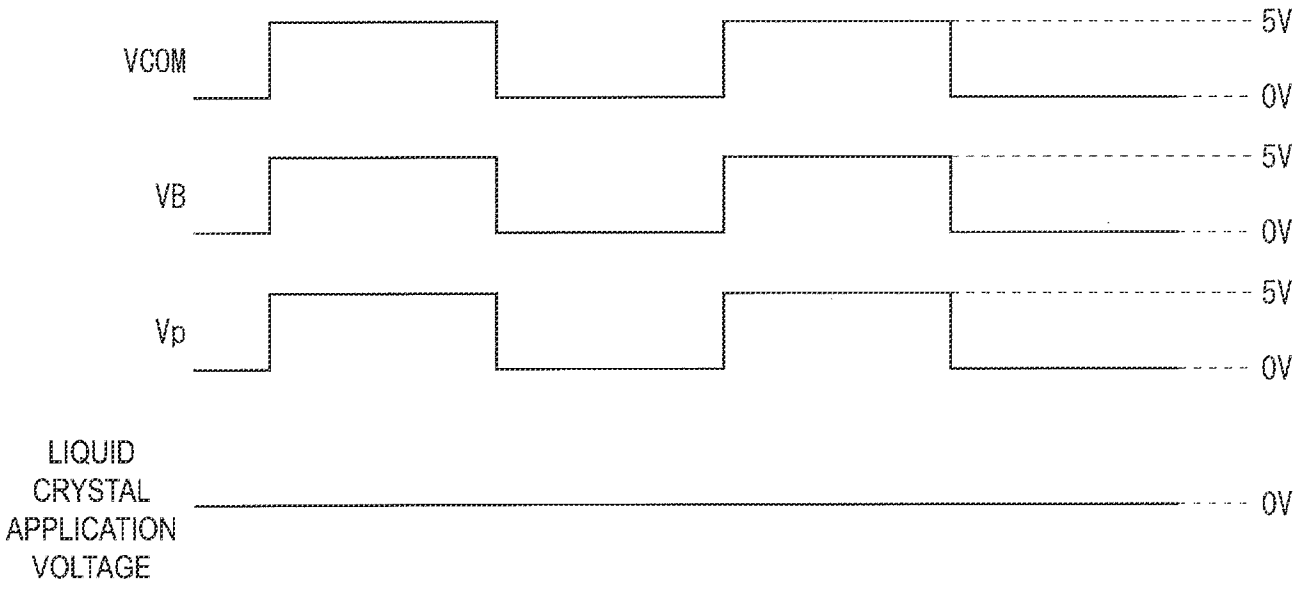
FIG. 25 is a waveform diagram when the white display is performed by the known memory liquid crystal display.
Figure 26:
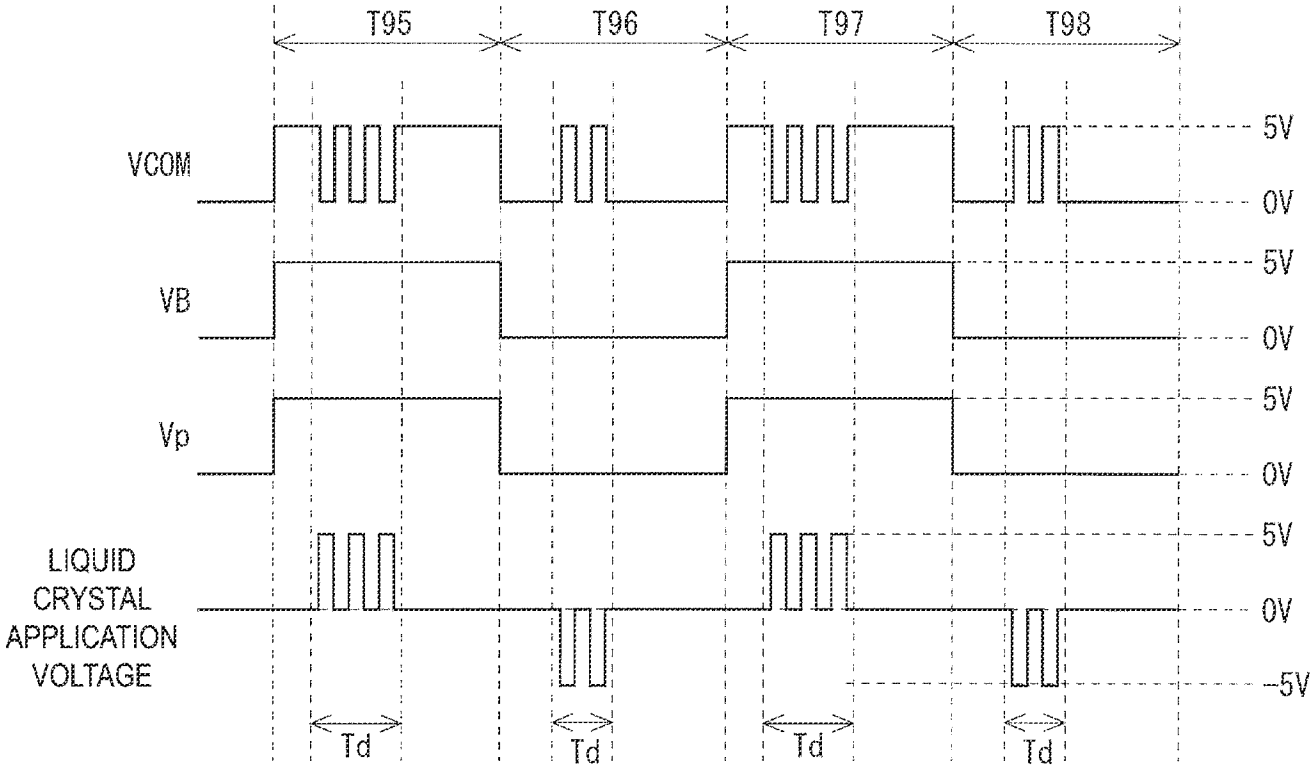
FIG. 26 is a waveform diagram when the white display is performed, assuming that the known memory liquid crystal display is provided with the in-cell type touch panel.

Next, a configuration of the pixel circuit 100 will be described. FIG. 1 is a schematic configuration illustrating the pixel circuit 100 in the present embodiment. As illustrated in FIG. 1, the pixel circuit 100 includes an input switch 110, a memory circuit 120, a voltage selection circuit 130, a liquid crystal capacitance 140 constituted by a pixel electrode 102 and the common electrode 70, and a state control circuit 150. Unlike the pixel circuit 900 (see FIG. 22) of the known memory liquid crystal display, the pixel circuit 100 in the present embodiment includes the state control circuit 150. The state control circuit 150 is provided between the voltage selection circuit 130 and the pixel electrode 102, and functions as a switch circuit configured to control an electrical connection state between the voltage selection circuit 130 and the pixel electrode 102. Note that a portion including the input switch 110, the memory circuit 120, and the voltage selection circuit 130 is referred to a "display color control unit" for convenience. The display color control unit is denoted by a reference numeral 101.

A state of the input switch 110 is controlled by the first scanning signal GLA and the second scanning signal GLB. When the input switch 110 is in an on state, the data signal SL is supplied to the memory circuit 120. Note that the data signal SL is binary data. The memory circuit 120 stores the binary data based on the data signal SL. The voltage selection circuit 130 selects either the black voltage VA or the white voltage VB in accordance with a value of the binary data stored in the memory circuit 120.

In the example illustrated in FIG. 1, the state control circuit 150 is constituted by one n-channel transistor 151 including a control terminal to which a floating control signal FCTL is supplied, a first conduction terminal connected to the voltage selection circuit 130, and a second conduction terminal connected to the pixel electrode 102. When the floating control signal FCTL is at the high level, the n-channel transistor 151 is in an on state, and when the floating control signal FCTL is at the low level, the re-channel transistor 151 is in an off state. Accordingly, when the floating control signal FCTL is at the high level, the voltage selection circuit 130 and the pixel electrode 102 are in a state of being electrically connected to each other, and when the floating control signal FCTL is at the low level, the voltage selection circuit 130 and the pixel electrode 102 are in a state of being electrically disconnected from each other. When the voltage selection circuit 130 and the pixel electrode 102 are in the state of being electrically disconnected from each other, the pixel electrode 102 is in a floating state. As described above, the state control circuit 150 has a function of switching the state of the pixel electrode 102 between the floating state and the non-floating state.

In a period when the n-channel transistor 151 is maintained in the on state, a voltage (black voltage VA or white voltage VB) selected by the voltage selection circuit 130 is applied to the pixel electrode 102, which is reflected in the display state of the pixel.

Figure 6:
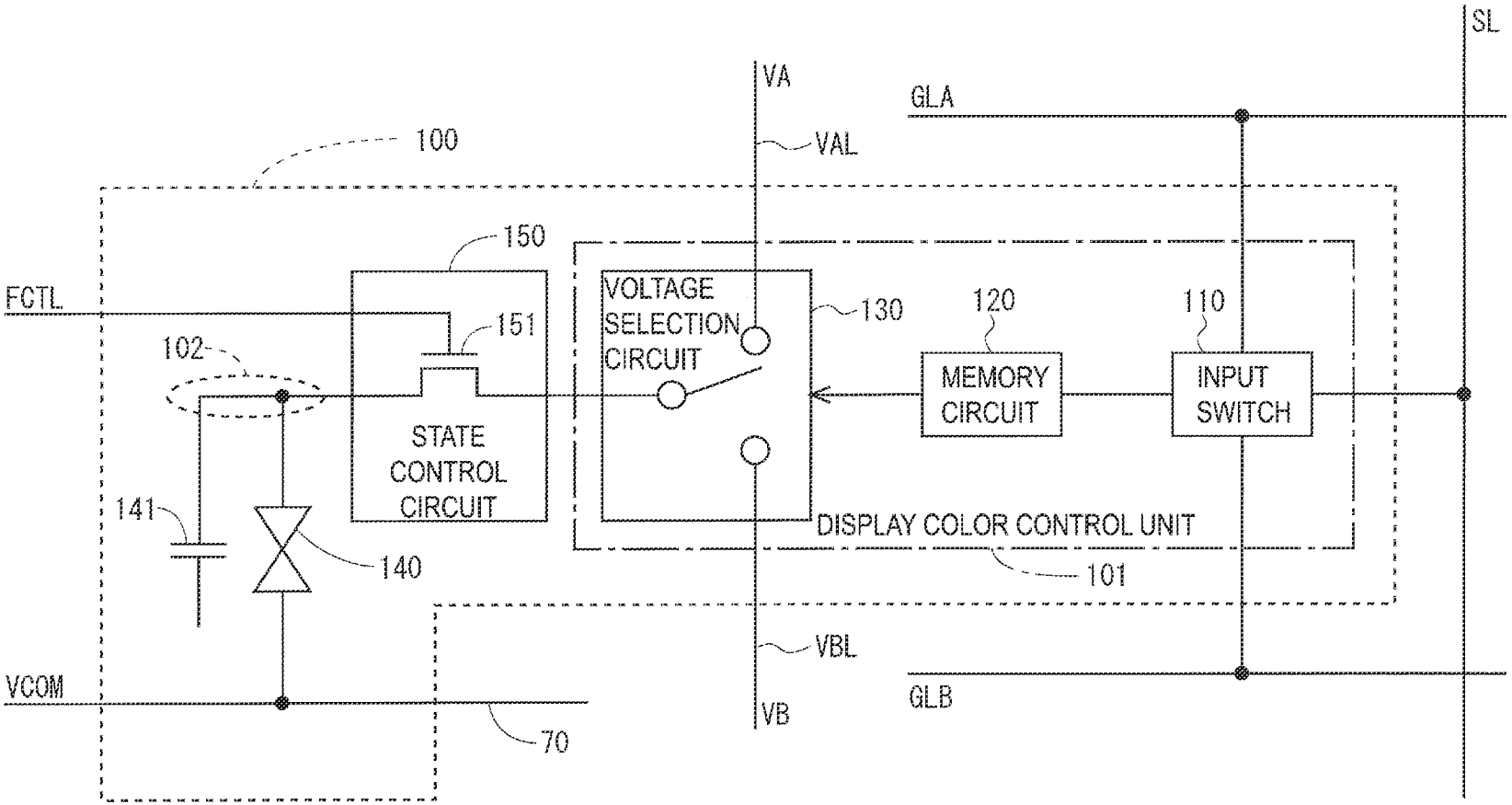
FIG. 6 is a diagram illustrating another example of the schematic configuration of the pixel circuit in the first embodiment.

Note that in a period when the pixel electrode 102 is in the floating state, neither the black voltage VA nor the white voltage VB is supplied to the pixel electrode 102. Thus, an auxiliary capacitance 141 may be provided in parallel with the liquid crystal capacitance 140, as illustrated in FIG. 6 so that the display state of the pixel is maintained throughout the period when the pixel electrode 102 is in the floating state. One end of the auxiliary capacitance 141 is connected to the pixel electrode 102. the other end of the auxiliary capacitance 141 is connected to, for example, a common electrode 70, a ground, a wiring line dedicated to auxiliary capacitance, and the like, although the connection destination is not particularly limited.

Figure 7:
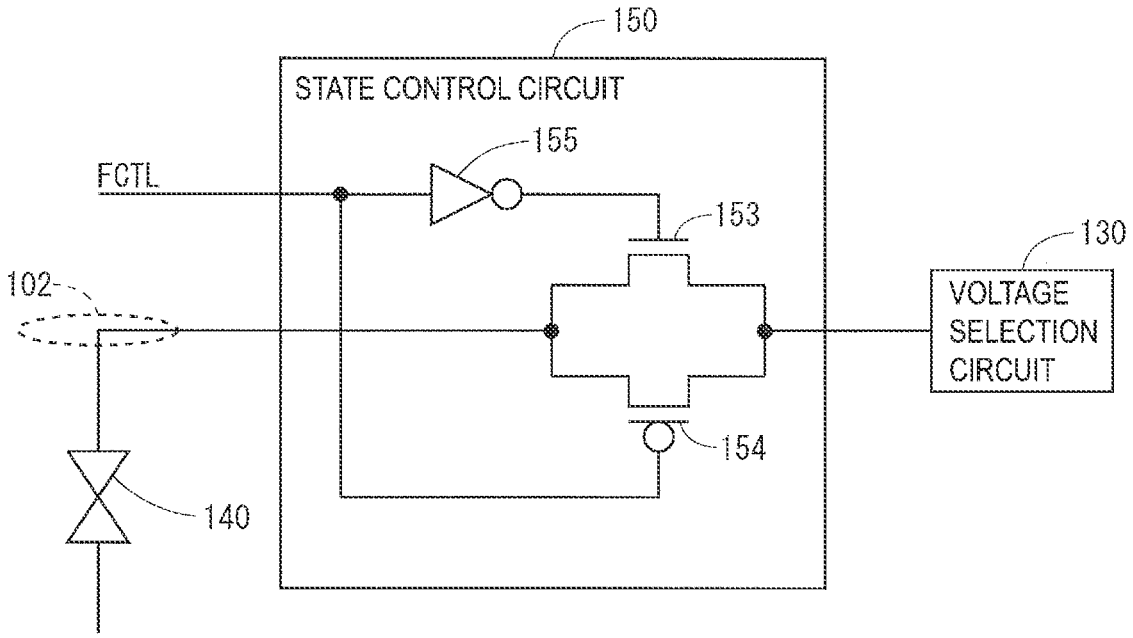
FIG. 7 is a diagram illustrating another example of a configuration of a state control circuit in the first embodiment.

In the example illustrated in FIG. 1, the state control circuit 150 is constituted by one n-channel transistor 151, but no such limitation is intended. For example, as illustrated in FIG. 7, the state control circuit 150 may be constituted of an n-channel transistor 153, a p-channel transistor 154, and an inverter 155. In this regard, the re-channel transistor 153 includes a control terminal connected to the output terminal of the inverter 155, a first conduction terminal connected to the voltage selection circuit 130, and a second conduction terminal connected to the pixel electrode 102. The p-channel transistor 154 includes a control terminal to which the floating control signal FCTL is supplied, a first conduction terminal connected to the voltage selection circuit 130, and a second conduction terminal connected to the pixel electrode 102. The inverter 155 includes an input terminal to which the floating control signal FCTL is supplied, and an output terminal connected to the control terminal of the n-channel transistor 153. According to the above configuration, when the floating control signal FCTL is at the high level, the voltage selection circuit 130 and the pixel electrode 102 are in the state of being electrically connected to each other, and when the floating control signal FCTL is at the low level, the voltage selection circuit 130 and the pixel electrode 102 are in the state of being electrically disconnected from each other.

Figure 8:
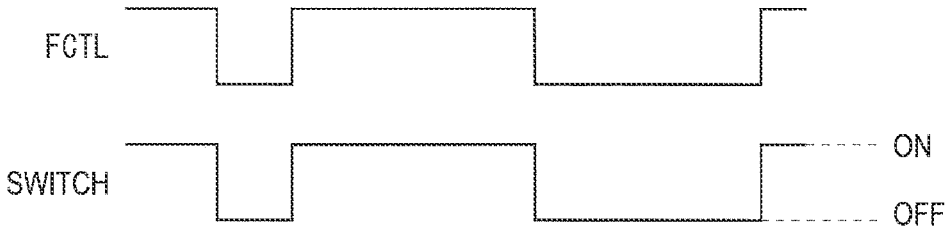
FIG. 8 is a diagram for describing a relationship between a level of a floating control signal and an on/off state of a switch (state control circuit) in the first embodiment.

Assuming that the state control circuit 150 is a switch, regardless of which configuration illustrated in FIGS. 1 and 7 the state control circuit 150 has, when the floating control signal FCTL is at the high level, the switch turns on, and when the floating control signal FCTL is at the low level, the switch turns off, as illustrated in FIG. 8. As described in detail below, in the touch detection period, the floating control signal FCTL is maintained at the low level. As a result, in the touch detection period, the pixel electrode 102 is maintained in the floating state.

Figure 9:
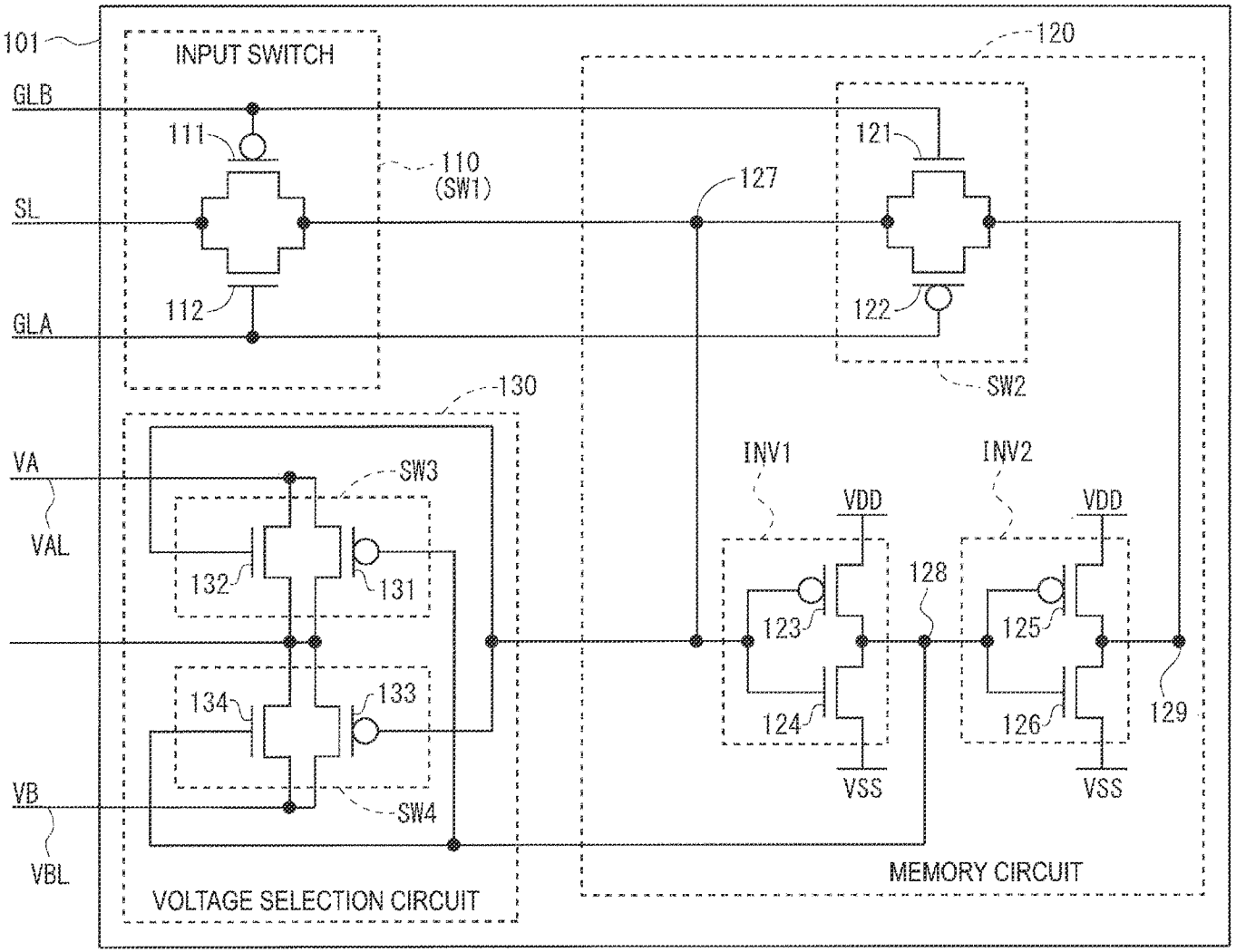
FIG. 9 is a circuit diagram illustrating a detailed configuration of a display color control unit according to the first embodiment.

FIG. 9 is a circuit diagram illustrating a detailed configuration of a display color control unit 101. Note that the configuration illustrated in FIG. 9 is merely an example, and no such limitation is intended. The display color control unit 101 includes the input switch 110, the memory circuit 120, and the voltage selection circuit 130. The first scanning signal GLA, the second scanning signal GLB, the data signal SL, the black voltage VA, and the white voltage VB, are supplied to the display color control unit 101.

The input switch 110 is a CMOS switch including a p-channel transistor 111 and an n-channel transistor 112. Note that in the following, the input switch 110 is also referred to as a "first switch". The first switch is denoted by a reference sign SW1. The first switch SW1 is in the on state in a case where the first scanning signal GLA is at the high level and the second scanning signal GLB is at the low level. When the first switch SW1 is in the on state, a source bus line for transmitting the data signal SL and a node 127 are electrically connected to each other. As described above, in a case where the first scanning signal GLA is at the high level and the second scanning signal GLB is at the low level. the first switch SW1 is in the on state, and the voltage of the data signal SL is supplied to the node 127.

The memory circuit 120 is constituted by a second switch SW2, which is a CMOS switch including an n-channel transistor 121 and p-channel transistor 122, a first inverter INV1, which is a CMOS inverter including a p-channel transistor 123 and an n-channel transistor 124, and a second inverter INV2, which is a CMOS inverter including a p-channel transistor 125 and an n-channel transistor 126. The second switch SW2 is in the on state in a case where the second scanning signal GLB is at the high level and the first scanning signal GLA is at the low level. When the second switch SW2 is in the on state, the node 127 and a node 129 are electrically connected to each other. The first inverter INV1 includes an input terminal connected to the node 127, and an output terminal connected to a node 128. The second inverter INV2 includes an input terminal connected to the node 128, and an output terminal connected to the node 129. In the configuration described above, the memory circuit 120 functions to hold a value (logic value) based on the voltage supplied to the node 127 in a case where the first switch SW1 is in the on state until the next time the first switch SW1 is in the on state.

The voltage selection circuit 130 is constituted by a third switch SW3, which is a CMOS switch including an p-channel transistor 131 and an n-channel transistor 132, and a fourth switch SW4, which is a CMOS switch including an p-channel transistor 133 and an n-channel transistor 134. The third switch SW3 is in the on state in a case where the voltage of the node 127 is at the high level and the voltage at the node 128 is at the low level. When the third switch SW3 is in the on state, the black voltage VA is output from the voltage selection circuit 130. The fourth switch SW4 is in the on state in a case where the voltage of the node 127 is at the low level and the voltage at the node 128 is at the high level. When the fourth switch SW4 is in the on state, the white voltage VB is output from the voltage selection circuit 130.

According to the configuration described above, binary data is stored in the memory circuit 120 based on the voltage of the data signal when the first switch SW1 is in the on state. In the voltage selection circuit 130, the display voltage (either the black voltage VA or the white voltage VB) to be applied to the pixel electrode 102 is selected based on the binary data stored in the memory circuit 120. Then, the display state of the pixel is a white display or a black display, based on the display voltage applied to the pixel electrode 102.

1.3 Driving Method

Figure 10:
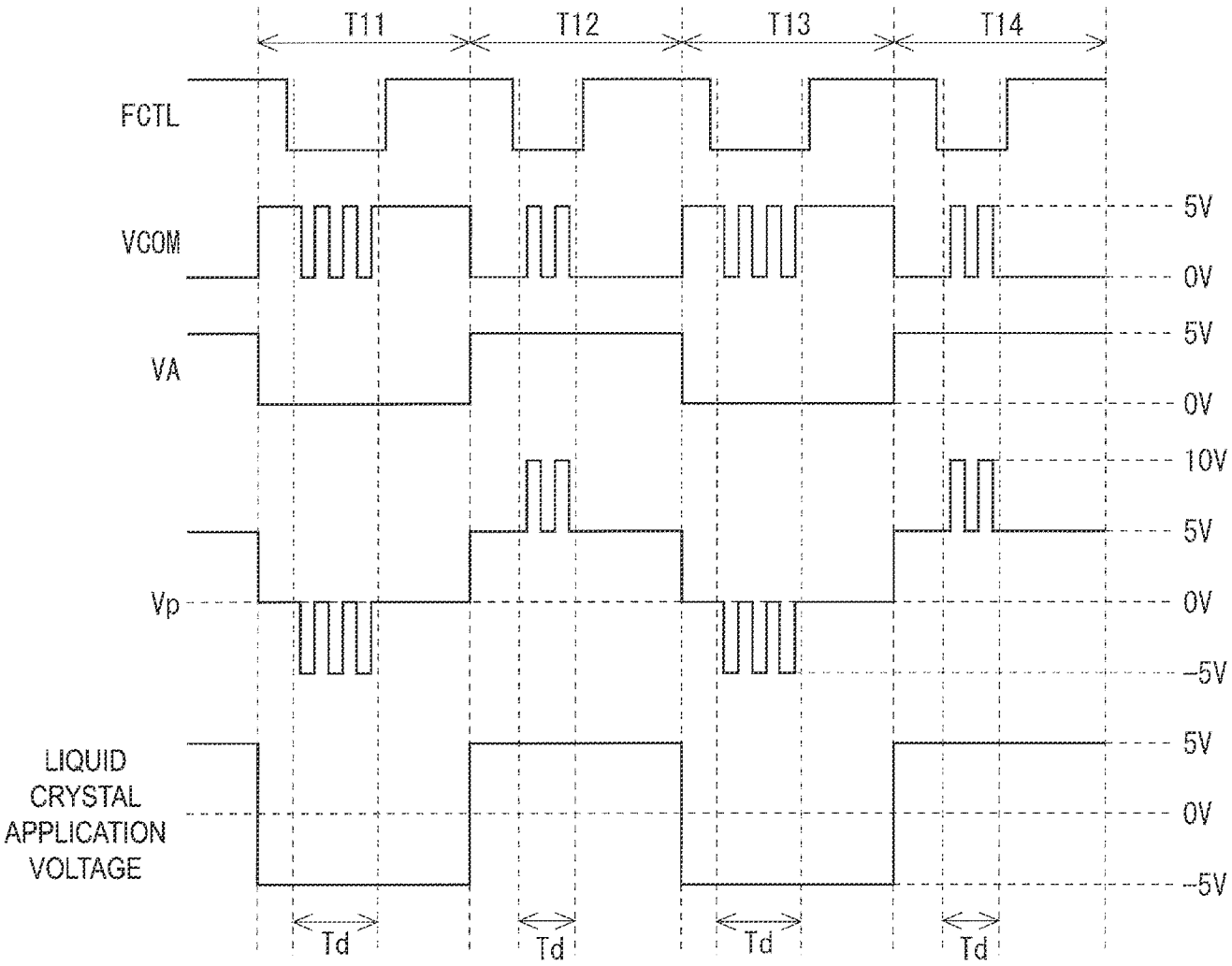
FIG. 10 is a waveform diagram when black display is performed by one pixel of interest in the first embodiment.

Next, a driving method will be described. FIG. 10 is a waveform diagram when the black display is performed by one pixel of interest. Focusing on periods other than the touch detection period Td, the common electrode voltage VCOM changes between 0 V and 5 V in synchronization with the change in the black voltage VA. Specifically, in the periods other than the touch detection period Td, the common electrode voltage VCOM is 5 V in a period in which the black voltage VA is 0 V, and the common electrode voltage VCOM is 0 V in a period in which the black voltage VA is 5 V. By selecting the black voltage VA by the voltage selection circuit 130, the pixel electrode voltage Vp is equal to the black voltage VA in the periods other than the touch detection period Td. As described above, in the period other than the touch detection period Td, the liquid crystal application voltage is −5 V in the period in which the common electrode voltage VCOM is 5 V, and the liquid crystal application voltage is 5 V in the period in which the common electrode voltage VCOM is 0 V. As a result, the black display is performed.

The pulse signal for touch detection is supplied to the common electrode 70 in the touch detection period Td. Accordingly, in the touch detection period Td, as illustrated in FIG. 10, the common electrode voltage VCOM varies between 0 V and 5 V. Here, under the control of the timing control circuit 20, the floating control signal FCTL changes from the high level to the low level before the start of the touch detection period Td, and changes from the low level to the high level after the end of the touch detection period Td. As described above, when the floating control signal FCTL is at the low level, the voltage selection circuit 130 and the pixel electrode 102 are in the state of being electrically disconnected from each other. As described above, the state of the pixel electrode 102 changes from the non-floating state to the floating state before the start of the touch detection period Td, and the state of the pixel electrode 102 returns from the floating state to the non-floating state after the end of the touch detection period Td. As described above, the pixel electrode 102 is maintained in the floating state throughout the touch detection period Td. Thus, in the touch detection period Td, when the common electrode voltage VCOM decreases, the pixel electrode voltage Vp also decreases, and when the common electrode voltage VCOM increases, the pixel electrode voltage Vp also increases. As a result, in periods T11 and T13, which are the periods in which the common electrode voltage VCOM is supposed to be maintained at 5 V, the liquid crystal application voltage is maintained at −5 V even in the touch detection period Td, and in periods T12 and T14, which are the periods in which the common electrode voltage VCOM is supposed to be maintained at 0 V, the liquid crystal application voltage is maintained at 5 V even in the touch detection period Td. Thus, the white display is not inserted in the period in which the black display is supposed to be performed.

Figure 11:
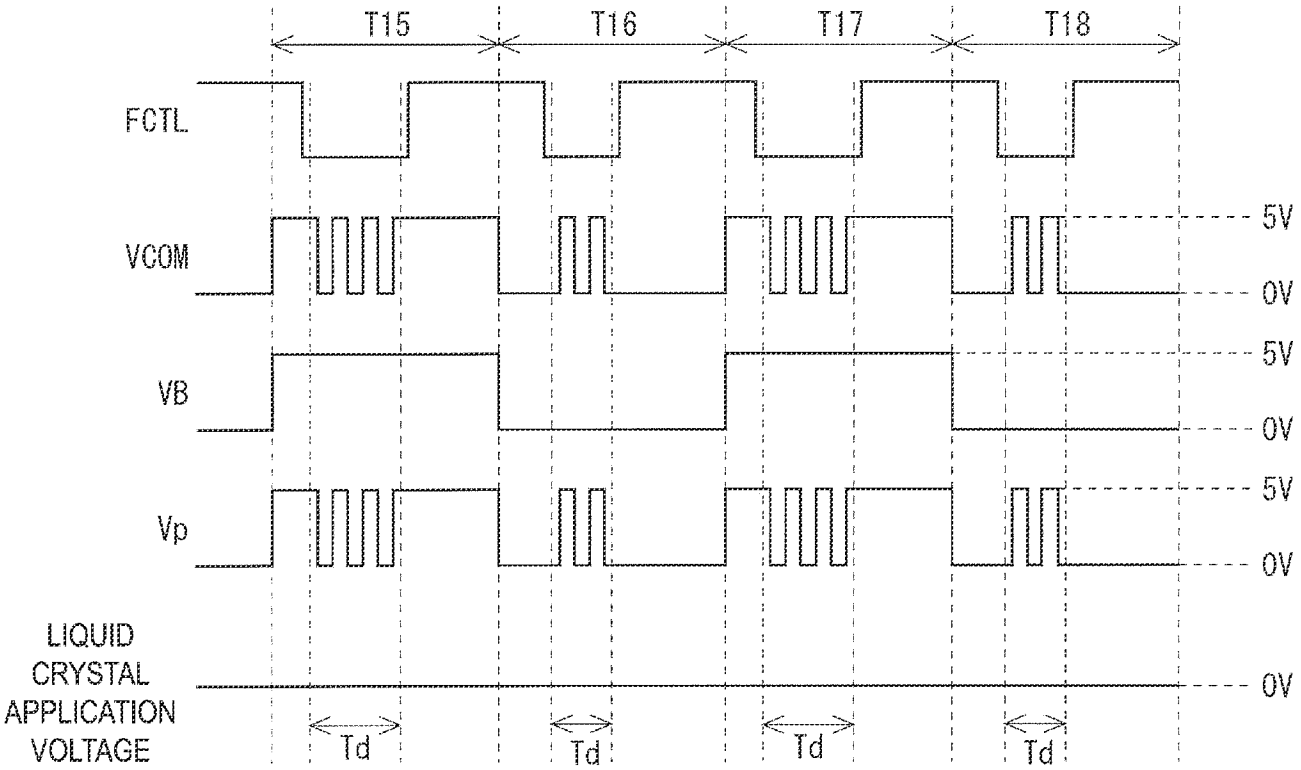
FIG. 11 is a waveform diagram when white display is performed by one pixel of interest in the first embodiment.

FIG. 11 is a waveform diagram when the white display is performed by one pixel of interest. Focusing on periods other than the touch detection period Td, the common electrode voltage VCOM changes between 0 V and 5 V in synchronization with the change in the white voltage VB. Specifically, in the periods other than the touch detection period Td, the common electrode voltage VCOM is 5 V in a period in which the white voltage VB is 5 V, and the common electrode voltage VCOM is 0 V in a period in which the white voltage VB is 0 V.

By selecting the white voltage VB by the voltage selection circuit 130, the pixel electrode voltage Vp is equal to the white voltage VB in the periods other than the touch detection period Td. As described above, in the period other than the touch detection period Td, the liquid crystal application voltage is 0 V both in the period in which the common electrode voltage VCOM is 5 V and in the period in which the common electrode voltage VCOM is 0 V. As a result, the white display is performed.

The pulse signal for touch detection is supplied to the common electrode 70 in the touch detection period Td, so that the common electrode voltage VCOM varies between 0 V and 5 V, as illustrated in FIG. 11. Here, under the control of the timing control circuit 20, the floating control signal FCTL changes from the high level to the low level before the start of the touch detection period Td, and changes from the low level to the high level after the end of the touch detection period Td. As a result, similar to the case where the black display is performed, the pixel electrode 102 is maintained in the floating state throughout the touch detection period Td. Thus, in the touch detection period Td, when the common electrode voltage VCOM decreases, the pixel electrode voltage Vp also decreases, and when the common electrode voltage VCOM increases, the pixel electrode voltage Vp also increases. As a result, both in periods T15 and T17, which are the periods in which the common electrode voltage VCOM is supposed to be maintained at 5 V, and in periods T16 and T18, which are the periods in which the common electrode voltage VCOM is supposed to be maintained at 0 V, the liquid crystal application voltage is maintained at 0 V throughout the touch detection period Td. Thus, the black display is not inserted in the period in which the white display is supposed to be performed.

Note that although in this description, an example has been described in which a cycle of polarity inversion of the liquid crystal application voltage and a scanning cycle of the touch panel 7 (a cycle of supplying the pulse signal for touch detection to the common electrode 70) are the same, no such limitation is intended, and the cycle of polarity inversion of the liquid crystal application voltage and the scanning cycle of the touch panel 7 may be different from each other. In one example, the frequency of the polarity inversion of the liquid crystal application voltage is set to 0.5 Hz, and the scanning rate of the touch panel 7 is set to 80 Hz.

1.4 Effects

According to the present embodiment, the state control circuit 150 configured to switch the state of the pixel electrode 102 between the floating state and the non-floating state is provided in the memory liquid crystal display (the liquid crystal display device provided with the memory circuit 120 in the pixel circuit 100) provided with the in-cell type touch panel 7 that uses the common electrode 70 as the electrode for touch detection. The state control circuit 150 changes the state of the pixel electrode 102 from the non-floating state to the floating state before the start of the touch detection period Td, and changes the state of the pixel electrode 102 from the floating state to the non-floating state after the end of the touch detection period Td. As a result, even when the pulse signal for touch detection is supplied to the common electrode 70 in the touch detection period Td, the pixel electrode voltage Vp also changes in accordance with the change in the common electrode voltage VCOM. Thus, the liquid crystal application voltage is maintained at the desired voltage throughout the touch detection period Td. Thus, the display defect (inversion of black and white) due to the pulse signal for touch detection being supplied to the common electrode 70 does not occur. As described above, according to the present embodiment, the memory liquid crystal display provided with the in-cell type touch panel 7 is realized.

2. Second Embodiment

A second embodiment will be described below. Note that points different from the first embodiment will be mainly described below.

2.1 Configuration for Controlling State of Pixel Electrode

In the first embodiment, the state of the pixel electrode 102 is controlled by providing between the voltage selection circuit 130 and the pixel electrode 102 the state control circuit 150 configured to function as the switch. In contrast, in the present embodiment, the state of the pixel electrode 102 is controlled by controlling the output from the memory circuit 120 to the voltage selection circuit 130. In order to realize the above, the state control circuit in the present embodiment is provided in the memory circuit 120. A detailed description will be given below.

Figure 12:
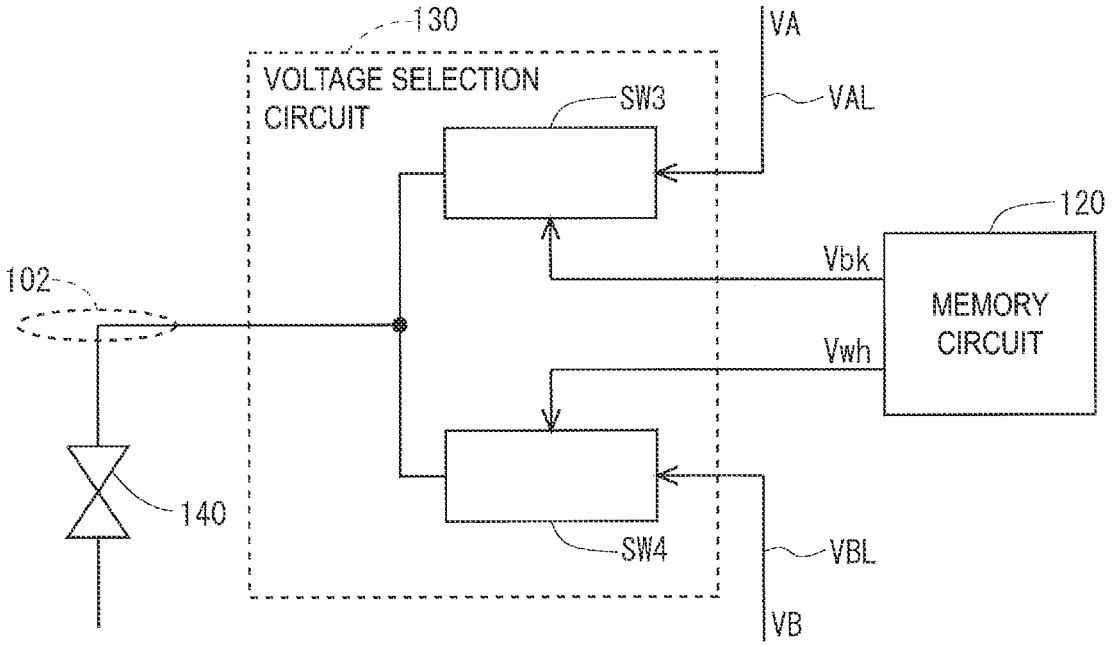
FIG. 12 is a block diagram illustrating a configuration of in the vicinity of a voltage selection circuit in a pixel circuit according to a second embodiment.

A configuration in the vicinity of the voltage selection circuit 130 in the pixel circuit 100 is schematically configured as illustrated in FIG. 12. As can be understood from FIG. 9, the voltage selection circuit 130 is connected to the nodes 127 and 128 in the memory circuit 120. When the voltage at the node 127 is at the high level, the third switch SW3 is in the on state, so that the black voltage VA is output from the voltage selection circuit 130, and when the voltage at the node 128 is at the high level, the fourth switch SW4 is in the on state, so that the white voltage VB is output from the voltage selection circuit 130. Thus, for the sake of convenience, a signal corresponding to the voltage at the node 127 is referred to as a "black voltage supply control signal", and a signal corresponding to the voltage at the node 128 is referred to as a "white voltage supply control signal". The black voltage supply control signal is denoted by a reference sign Vbk, and the white voltage supply control signal is denoted by a reference sign Vwh (see FIG. 12). Note that the third switch SW3 corresponds to a first voltage supply control switch circuit, the fourth switch SW4 corresponds to a second voltage supply control switch circuit, the black voltage supply control signal Vbk corresponds to a first voltage supply control signal, and the white voltage supply control signal Vwh corresponds to a second voltage supply control signal.

As illustrated in FIG. 13, in a period in which the black display is supposed to be performed (by one pixel of interest), the black voltage supply control signal Vbk is at the high level, the white voltage supply control signal Vwh is at the low level, and the pixel electrode voltage Vp is equal to the black voltage VA. In addition, in a period in which the white display is supposed to be performed (by one pixel of interest), the black voltage supply control signal Vbk is at the low level, the white voltage supply control signal Vwh is at the high level, and the pixel electrode voltage Vp is equal to the white voltage VB. Here, in the present embodiment, in the touch detection period Td, the levels of the black voltage supply control signal Vbk and the white voltage supply control signal Vwh are controlled so that the pixel electrode 102 is high impedance (in the floating state). Specifically, in the touch detection period Td, the black voltage supply control signal Vbk is set to the low level and the white voltage supply control signal Vwh is also set to the low level (see FIG. 13).

Figure 14:
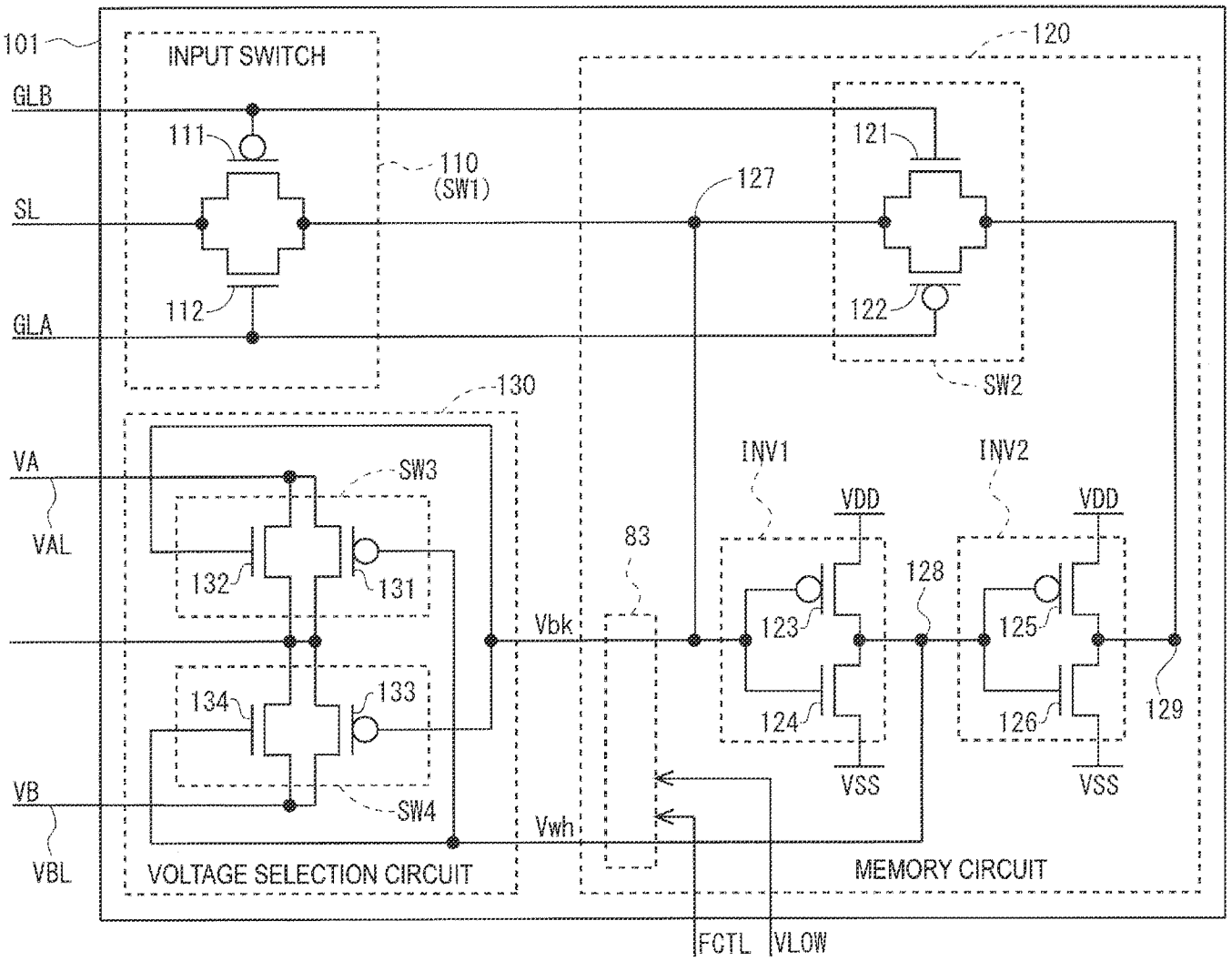
FIG. 14 is a diagram for describing a position where a state control circuit is provided in the second embodiment.
Figure 15:
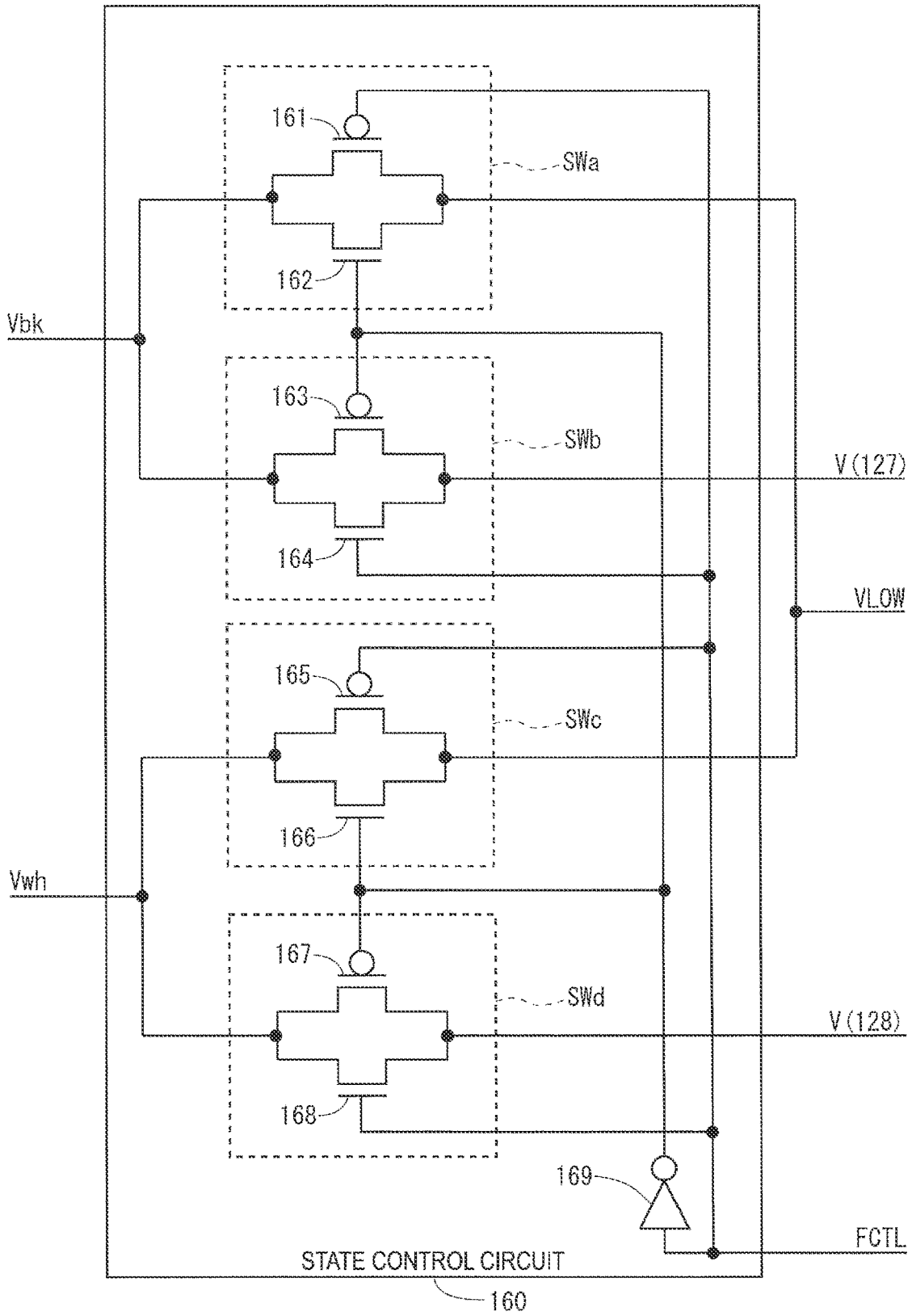
FIG. 15 is a circuit diagram illustrating a configuration of the state control circuit in the second embodiment.

In order to enable the above-described control, in the present embodiment, a state control circuit 160 having a configuration such as that illustrated in FIG. 15 is provided in a position denoted by a reference numeral 83 in FIG. 14. The state control circuit 160 includes a CMOS switch SWa including a p-channel transistor 161 and an n-channel transistor 162, a CMOS switch SWb including a p-channel transistor 163 and an n-channel transistor 164, a CMOS switch SWc including a p-channel transistor 165 and an n-channel transistor 166, a CMOS switch SWd including a p-channel transistor 167 and an n-channel transistor 168, and an inverter 169. A low-level voltage VLOW is supplied to an input terminal of the CMOS switch SWa and an input terminal of the CMOS switch SWc. A voltage V(127) of the node 127 is supplied to an input terminal of the CMOS switch SWb. A voltage V(128) of the node 128 is supplied to an input terminal of the CMOS switch SWd. The floating control signal FCTL is supplied to control terminals of the p-channel transistor 161, the n-channel transistor 164, the p-channel transistor 165, and the n-channel transistor 168. As illustrated in FIG. 15, since the inverter 169 is provided, a logical inversion signal of the floating control signal FCTL is supplied to control terminals of the n-channel transistor 162, the p-channel transistor 163, the n-channel transistor 166, and the p-channel transistor 167.

As described above, when the floating control signal FCTL is at the high level, the CMOS switch SWb and the CMOS switch SWd are in the on state, the voltage V(127) of the node 127 is output as the black voltage supply control signal Vbk, and the voltage V(128) of the node 128 is output as the white voltage supply control signal Vwh. At this time, since the pixel electrode 102 is electrically connected to either the black voltage supply line VAL or the white voltage supply line VBL, the pixel electrode 102 is maintained in the non-floating state. On the other hand, when the floating control signal FCTL is at the low level, the CMOS switch SWa and the CMOS switch SWc are in the on state, the low-level voltage VLOW is output as the black voltage supply control signal Vbk, and the white voltage supply control signal Vwh. At this time, as described above, the pixel electrode 102 is high impedance (in the floating state).

As described above, the state control circuit 160 in the present embodiment functions as a switching circuit configured to switch the level of the black voltage supply control signal Vbk between the high level (on level) and the low level (off level), and switch the level of the white voltage supply control signal Vwh between the high level (on level) and the low level (off level), wherein the switching circuit maintains the level of the black voltage supply control signal Vbk and the level of the white voltage supply control signal Vwh at the low level (off level) in the touch detection period Td.

2.2 Driving Method

Also in the present embodiment, similar to the first embodiment, under the control of the timing control circuit 20, the floating control signal FCTL changes from the high level to the low level before the start of the touch detection period Td, and changes from the low level to the high level after the end of the touch detection period Td (see FIGS. 10 and 11). As described above, when the floating control signal FCTL is at the high level, the pixel electrode 102 is in the non-floating state, and when the floating control signal FCTL is at the low level, the pixel electrode 102 is in the floating state. As described above the pixel electrode 102 is maintained in the floating state throughout the touch detection period Td. Thus, the liquid crystal application voltage is maintained at the desired voltage throughout the touch detection period Td.

2.3 Effects

Also in the present embodiment, the state of the pixel electrode 102 changes from the non-floating state to the floating state before the start of the touch detection period Td, and the state of the pixel electrode 102 changes from the floating state to the non-floating state after the end of the touch detection period Td. Accordingly, even when the pulse signal for touch detection is supplied to the common electrode 70 in the touch detection period Td, the pixel electrode voltage Vp also changes in accordance with the change in the common electrode voltage VCOM. Thus, similar to the first embodiment, the display defect (inversion of black and white) due to the pulse signal for touch detection being supplied to the common electrode 70 does not occur. As described above, also in the present embodiment, the memory liquid crystal display provided with the in-cell type touch panel 7 is realized.

3. Third Embodiment

3.1 Configuration for Controlling State of Pixel Electrode

In the present embodiment, in contrast to the first embodiment and the second embodiment, components for switching the state of the pixel electrode 102 between the floating state and the non-floating state is provided outside the liquid crystal panel 6. A detailed description will be given below.

Also in the present embodiment, the display voltage generation circuit 65 configured to generate the black voltage VA and the white voltage VB is provided inside the IC (see FIGS. 2,3, and 5) mounted in the frame region 81 on the TFT array substrate 3. The black voltage VA generated by the display voltage generation circuit 65 is supplied to the voltage selection circuit 130 in the pixel circuit 100 by the black voltage supply line VAL, and the white voltage VB generated by the display voltage generation circuit 65 is supplied to the voltage selection circuit 130 in the pixel circuit 100 by the white voltage supply line VBL.

Figure 16:
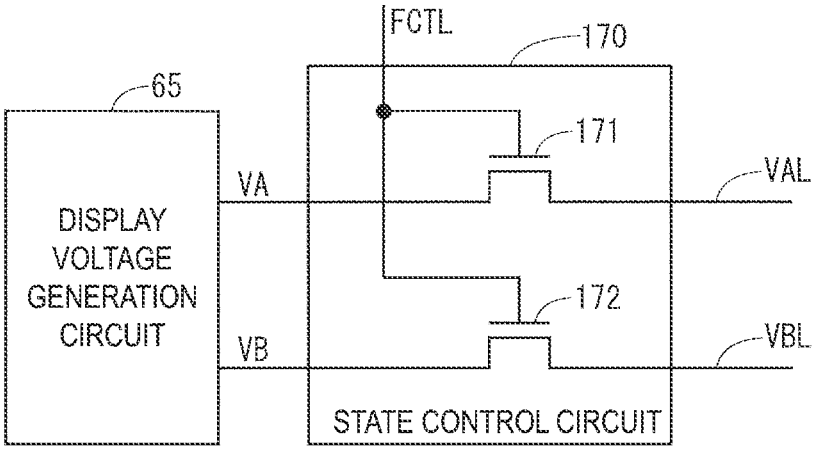
FIG. 16 is a circuit diagram illustrating a configuration of a state control circuit in a third embodiment.

Under the above assumptions, as illustrated in FIG. 16, a state control circuit 170 configured to switch the state of the pixel electrode 102 between the floating state and the non-floating state is provided in a region between the black voltage supply line VAL and the display voltage generation circuit 65 and between the white voltage supply line VBL and the display voltage generation circuit 65. The state control circuit 170 is typically provided inside the IC 8, but may be provided in a region outside the IC 8.

In the example illustrated in FIG. 16, the state control circuit 170 is constituted by two n-channel transistors 171 and 172. The n-channel transistor 171 includes a control terminal to which the floating control signal FCTL is supplied, a first conduction terminal connected to the display voltage generation circuit 65 (more specifically, connected to the output terminal for the black voltage VA of the display voltage generation circuit 65), and a second conduction terminal connected to the black voltage supply line VAL. The n-channel transistor 172 includes a control terminal to which the floating control signal FCTL is supplied, a first conduction terminal connected to the display voltage generation circuit 65 (more specifically, connected to the output terminal for the white voltage VB of the display voltage generation circuit 65), and a second conduction terminal connected to the white voltage supply line VBL. When the floating control signal FCTL is at the high level, the n-channel transistors 171 and 172 are in the on state, and when the floating control signal FCTL is at the low level, the n-channel transistors 171 and 172 are in the off state. Accordingly, when the floating control signal FCTL is at the high level, the display voltage generation circuit 65 and the black voltage supply line VAL are in the state of being electrically connected to each other, and the display voltage generation circuit 65 and the white voltage supply line VBL are in the state of being electrically connected to each other. When the floating control signal FCTL is at the low level, the display voltage generation circuit 65 and the black voltage supply line VAL are in the state of being electrically disconnected from each other, and the display voltage generation circuit 65 and the white voltage supply line VBL are in the state of being electrically disconnected from each other.

Figure 17:
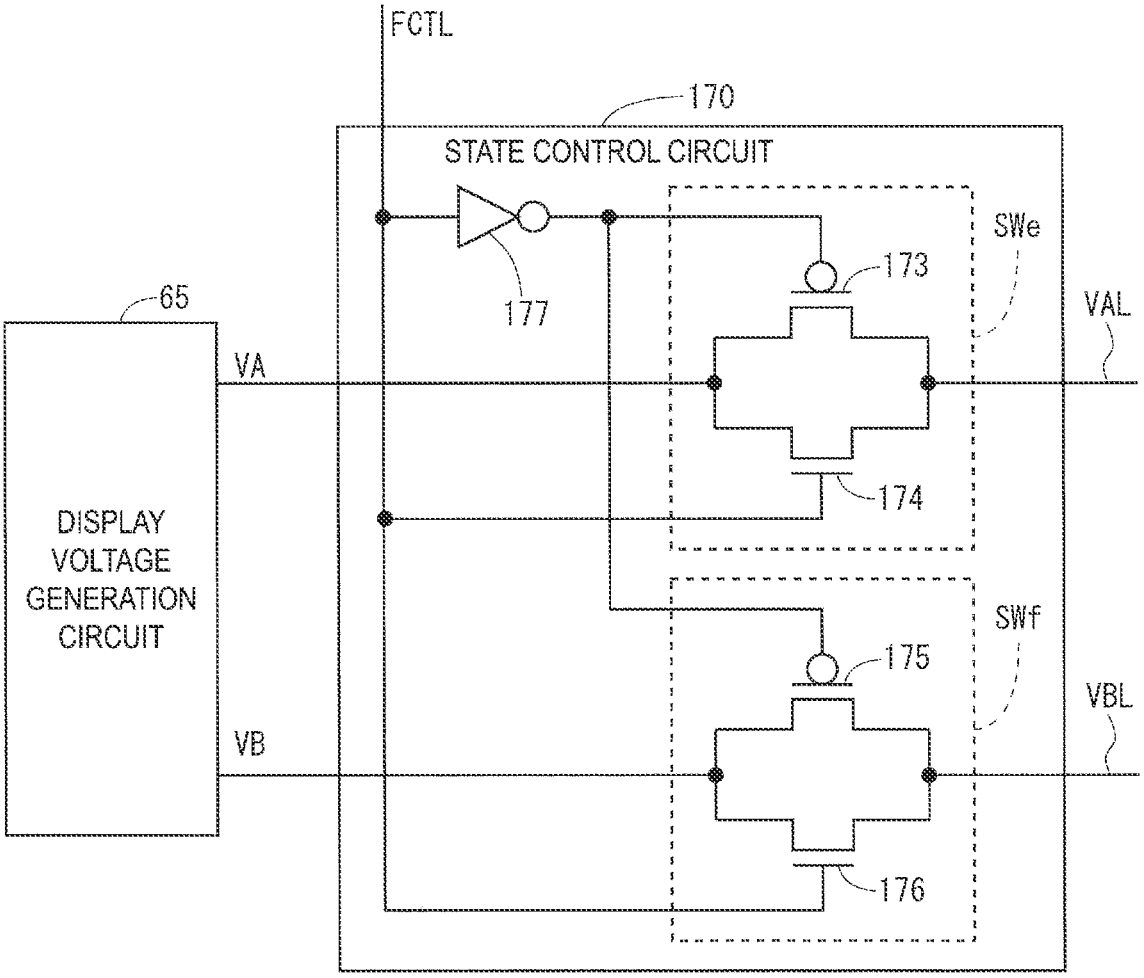
FIG. 17 is a circuit diagram illustrating another configuration of the state control circuit in the third embodiment.

Note that the configuration of the state control circuit 170 is not limited to the configuration illustrated in FIG. 16, and a configuration such as that illustrated in FIG. 17, for example, may be employed. The state control circuit 170 illustrated in FIG. 17 includes a CMOS switch SWe including a p-channel transistor 173 and an n-channel transistor 174, a CMOS switch SWf including a p-channel transistor 175 and an n-channel transistor 176, and an inverter 177. The CMOS switch SWe includes an input terminal connected to the display voltage generation circuit 65 (more specifically, connected to the output terminal for the black voltage VA of the display voltage generation circuit 65), and the CMOS switch SWf includes an input terminal connected to the display voltage generation circuit 65 (more specifically, connected to the output terminal for the white voltage VB of the display voltage generation circuit 65). The CMOS switch SWe includes an output terminal connected to the black voltage supply line VAL, and the CMOS switch SWf includes an output terminal connected to the white voltage supply line VBL. The floating control signal FCTL is supplied to control terminals of the n-channel transistor 174 and the n-channel transistor 176. As illustrated in FIG. 17, since the inverter 177 is provided, a logical inversion signal of the floating control signal FCTL is supplied to control terminals of the p-channel transistor 173, and the p-channel transistor 175. As described above, when the floating control signal FCTL is at the high level, the CMOS switch SWe and the CMOS switch SWf are in the on state, so that the display voltage generation circuit 65 and the black voltage supply line VAL are in the state of being electrically connected to each other, and the display voltage generation circuit 65 and the white voltage supply line VBL are in the state of being electrically connected to each other. On the other hand, when the floating control signal FCTL is at the low level, the CMOS switch SWe and the CMOS switch SWf are in the off state, so that the display voltage generation circuit 65 and the black voltage supply line VAL are in the state of being electrically disconnected from each other, and the display voltage generation circuit 65 and the white voltage supply line VBL are in the state of being electrically disconnected from each other.

3.2 Driving Method

Also in the present embodiment, similar to the first embodiment, under the control of the timing control circuit 20, the floating control signal FCTL changes from the high level to the low level before the start of the touch detection period Td, and changes from the low level to the high level after the end of the touch detection period Td (see FIGS. 10 and 11). As described above, when the floating control signal FCTL is at the high level, the display voltage generation circuit 65 and the black voltage supply line VAL are in the state of being electrically connected to each other, and the display voltage generation circuit 65 and the white voltage supply line VBL are in the state of being electrically connected to each other. Furthermore, when the floating control signal FCTL is at the low level, the display voltage generation circuit 65 and the black voltage supply line VAL are in the state of being electrically disconnected from each other, and the display voltage generation circuit 65 and the white voltage supply line VBL are in the state of being electrically disconnected from each other. As described above, the state control circuit 170 electrically disconnects the display voltage generation circuit 65 and the black voltage supply line VAL from each other and electrically disconnect the display voltage generation circuit 65 and the white voltage supply line VBL from each other before the start of the touch detection period Td, and electrically connects the display voltage generation circuit 65 and the black voltage supply line VAL to each other and electrically connects the display voltage generation circuit 65 and the white voltage supply line VBL to each other after the end of the touch detection period Td. Thus, the black voltage supply line VAL and the white voltage supply line VBL are maintained in the floating state throughout the touch detection period Td. Thus, both in the pixel in which the black display is being performed and in the pixel in which the white display is being performed, the pixel electrode 102 is maintained in the floating state throughout the touch detection period Td. Thus, the liquid crystal application voltage is maintained at the desired voltage throughout the touch detection period Td.

3.3 Effects

According to the present embodiment, the state of the pixel electrode 102 can be switched between the floating state and the non-floating state by the state control circuit 170 provided outside the liquid crystal panel 6. Thus, the configuration of the pixel circuit 100 can prevent display defects (inversion of black and white) due to the pulse signal for touch detection being supplied to the common electrode 70, without changing the configuration from the known configuration (see FIG. 22). As described above, also in the present embodiment, the memory liquid crystal display provided with the in-cell type touch panel 7 is realized.

4. Modification Example

4.1 First Modification Example

In each of the above-described embodiments, the pulse signal for touch detection is supplied to the common electrode 70 in the touch detection period Td. Various wiring lines such as the first gate bus line, the second gate bus line, the source bus line, the black voltage supply line VAL, the white voltage supply line VBL, and the like are arranged on the common electrode 70. When the potentials of the various wiring lines are maintained at a fixed potential, parasitic capacitances can be formed by the various wiring lines and the common electrode 70. Thus, in consideration of the presence of such parasitic capacitances, it is necessary to reduce the frequency of the pulse signal for touch detection.

Thus, in the present modification example, in order to prevent the various wiring lines from causing parasitic capacitance formation in the touch detection period Td, components for maintaining the various wiring lines in the floating state through the touch detection period Td are provided. Specifically, a switch circuit configured to switch the various wiring lines between the floating state and the non-floating state is provided at positions denoted by reference numerals 86 to 88 in FIG. 18. A detailed description will be further given below.

Figure 18:
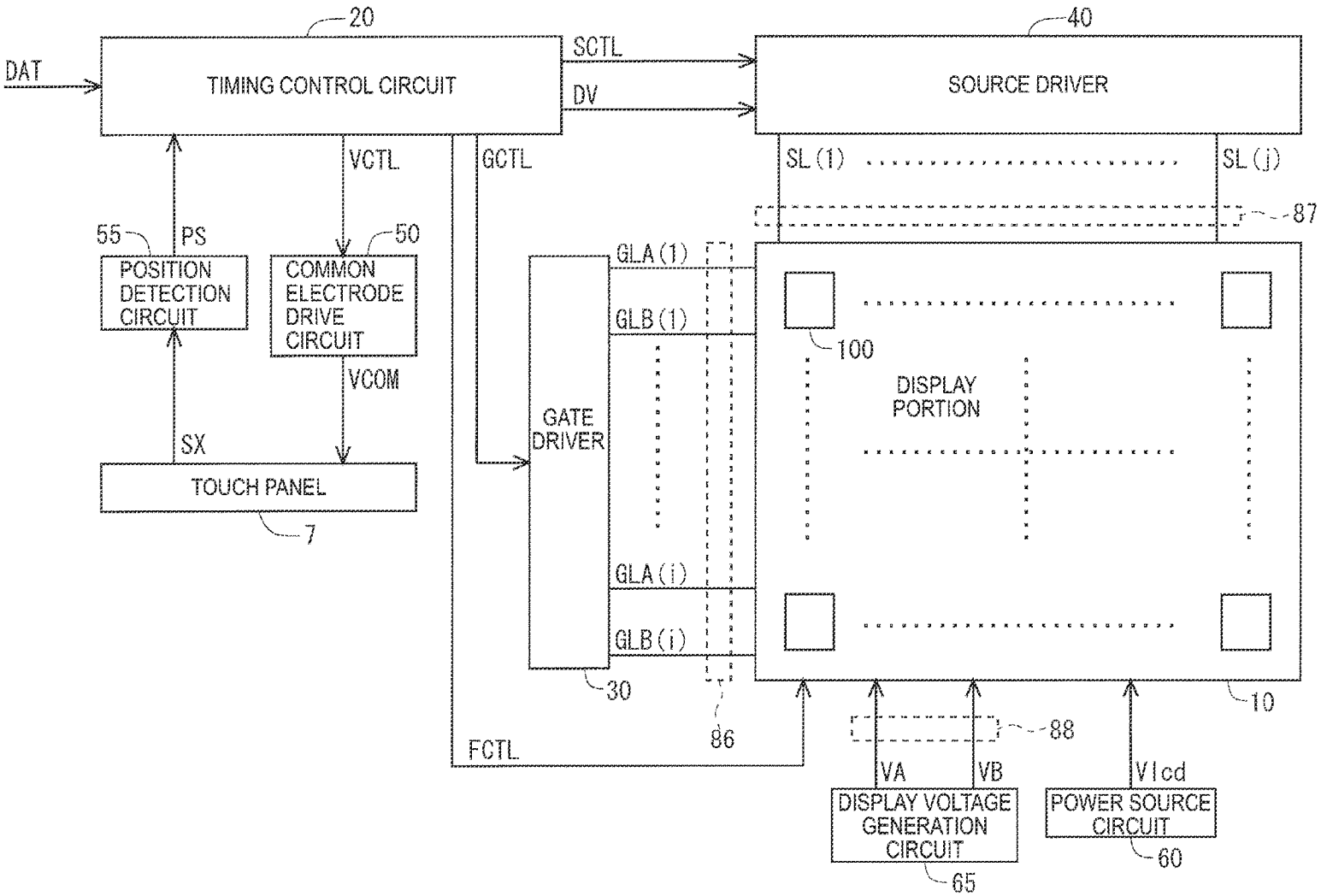
FIG. 18 is a block diagram for describing a configuration of a liquid crystal display device in a first modification example.

A scanning signal supply control switch circuit configured to control the electrical connection state between the gate driver 30 and the first gate bus line and the second gate bus line in the display portion 10 is provided in the position denoted by the reference numeral 86 in FIG. 18. The floating control signal FCTL is supplied to the scanning signal supply control switch circuit. When the floating control signal FCTL is at the high level, the gate driver 30 and the first gate bus line and the second gate bus line in the display portion 10 are in the state of being electrically connected to each other, and when the floating control signal FCTL is at the low level, the gate driver 30 and the first gate bus line and the second gate bus line in the display portion 10 are in the state of being electrically disconnected from each other. As described above, the scanning signal supply control switch circuit electrically disconnects the gate driver 30 and the first gate bus line and the second gate bus line in the display portion 10 from each other before the start of the touch detection period Td, and electrically connects the gate driver 30 and the first gate bus line and the second gate bus line in the display portion 10 to each other after the end of the touch detection period Td. As a result, the first gate bus line and the second gate bus line are prevented from causing the parasitic capacitance formation in the touch detection period Td.

A data signal supply control switch circuit configured to control the electrical connection state between the source driver 40 and the source bus line in the display portion 10 is provided in the position denoted by the reference numeral 87 in FIG. 18. The floating control signal FCTL is supplied to the data signal supply control switch circuit. When the floating control signal FCTL is at the high level, the source driver 40 and the source bus line in the display portion 10 are in the state of being electrically connected to each other, and when the floating control signal FCTL is at the low level, the source driver 40 and the source bus line in the display portion 10 are in the state of being electrically disconnected from each other. As described above, the data signal supply control switch circuit electrically disconnects the source driver 40 and the source bus line in the display portion 10 from each other before the start of the touch detection period Td, and electrically connects the source driver 40 and the source bus line in the display portion 10 to each other after the end of the touch detection period Td. As a result, the source bus line is prevented from causing the parasitic capacitance formation in the touch detection period Td.

A display voltage supply control switch circuit configured to control the electrical connection state between the display voltage generation circuit 65 and the black voltage supply line VAL and the white voltage supply line VBL in the display portion 10 is provided in the position denoted by the reference numeral 88 in FIG. 18. The floating control signal FCTL is supplied to the display voltage supply control switch circuit. When the floating control signal FCTL is at the high level, the display voltage generation circuit 65 and the black voltage supply line VAL and the white voltage supply line VBL in the display portion 10 are in the state of being electrically connected to each other, and when the floating control signal FCTL is at the low level, the display voltage generation circuit 65 and the black voltage supply line VAL and the white voltage supply line VBL in the display portion 10 are in the state of being electrically disconnected from each other. As described above, the display voltage supply control switch circuit electrically disconnects the display voltage generation circuit 65 and the black voltage supply line VAL and the white voltage supply line VBL in the display portion 10 from each other before the start of the touch detection period Td, and electrically connects the display voltage generation circuit 65 and the black voltage supply line VAL and the white voltage supply line VBL in the display portion 10 to each other after the end of the touch detection period Td. As a result, the black voltage supply line VAL and the white voltage supply line VBL are prevented from causing the parasitic capacitance formation in the touch detection period Td.

Note that the display voltage supply control switch circuit provided at the position denoted by the reference numeral 88 in FIG. 18 corresponds to the state control circuit 170 (see FIGS. 16 and 17) in the third embodiment. Accordingly, when the present modification is applied to the third embodiment, the scanning signal supply control switch circuit and the data signal supply control switch circuit are added to the configuration of the third embodiment. When the present modification is applied to the first and second embodiments, the scanning signal supply control switch circuit, the data signal supply control switch circuit, and the display voltage supply control switch circuit are added to the configurations in the first and second embodiments.

4.2 Second Modification Example

In each of the embodiments described above, a case where both an amplitude of the pulse signal for touch detection and an amplitude of the common electrode voltage VCOM in the periods other than the touch detection period Td are 5 V is described as an example, but no such limitation is intended. The amplitude of the pulse signal for touch detection and the amplitude of the common electrode voltage VCOM in the periods other than the touch detection period Td can be freely set. The amplitude of the pulse signal for touch detection and the amplitude of the common electrode voltage VCOM in the periods other than the touch detection period Td may be different from each other. For example, as illustrated in FIG. 19, the amplitude of the common electrode voltage VCOM in the periods other than the touch detection period Td may be 5 V, and the amplitude of the pulse signal for touch detection may be 3 V.

Figure 20:
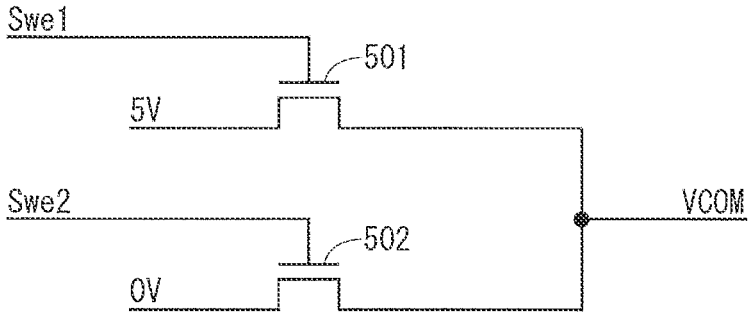
FIG. 20 is a circuit diagram illustrating a configuration example of a common electrode drive circuit in the first to third embodiments.

In the embodiments described above, the common electrode drive circuit 50 (see FIG. 3) includes, for example, as illustrated in FIG. 20, a transistor 501 whose state is controlled by a control signal Swe1 and a transistor 502 whose state is controlled by a control signal Swe2 (the control signal Swe1 and the control signal Swe2 correspond to the common electrode control signal VCTL). When a voltage of 5 V is applied to the common electrode 70, only the transistor 501 is in the on state, and when a voltage of 0 V is applied to the common electrode 70, only the transistor 502 is in the on state. Note that although the transistors 501 and 502 functioning as switches are illustrated as re-channel transistors in FIG. 20, each transistor functioning as a switch may be realized by, for example, a p-channel transistor or a CMOS transistor (the same applies to FIG. 21).

Figure 19:
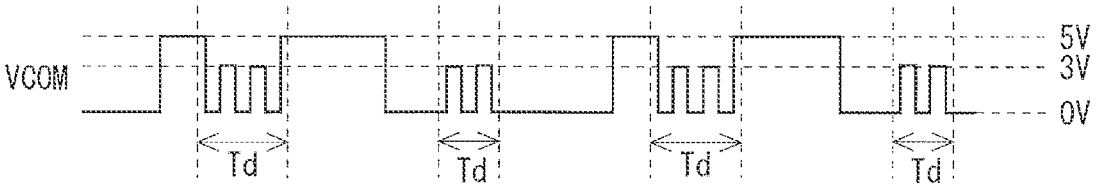
FIG. 19 is a diagram illustrating an example of a waveform of a common electrode voltage in a second modification example.
Figure 21:
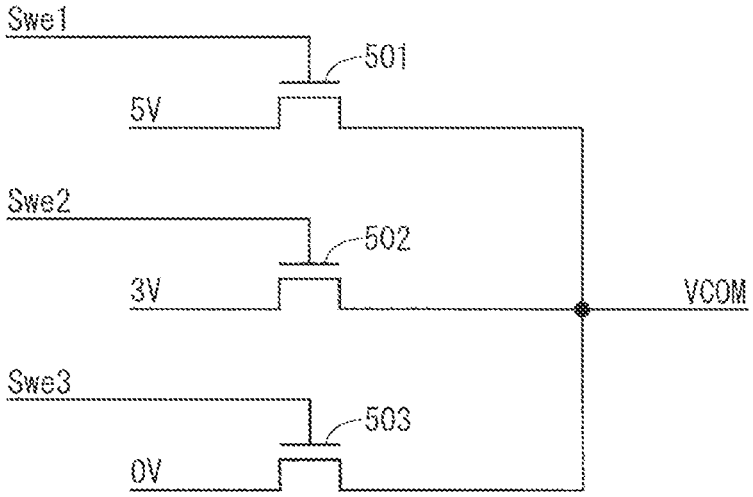
FIG. 21 is a circuit diagram illustrating a configuration example of a common electrode drive circuit in the second modification example.

In contrast, in a case where a waveform such as that illustrated in FIG. 19 is employed, the common electrode drive circuit 50 includes, for example, as illustrated in FIG. 21, the transistor 501 whose state is controlled by the control signal Swe1, the transistor 502 whose state is controlled by the control signal Swe2 and a transistor 503 whose state is controlled by a control signal Swe3 (the control signals Swe1 to Swe3 correspond to the common electrode control signal VCTL). When a voltage of 5 V is applied to the common electrode 70, only the transistor 501 is in the on state, when a voltage of 3 V is applied to the common electrode 70, only the transistor 502 is in the on state, and when a voltage of 0 V is applied to the common electrode 70, only the transistor 503 is in the on state.

5. Other

In the above, although the description is made focusing on a normally-white type liquid crystal display device, the disclosure can also be applied to a normally-black type liquid crystal display device.

Although the disclosure has been described in detail above, the above description is exemplary in all respects and is not limiting. It is understood that numerous other modifications or variations can be made without departing from the scope of the disclosure.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A liquid crystal display device including a liquid crystal panel with a built-in touch panel, the liquid crystal display device comprising:

a plurality of pixel circuits each including a liquid crystal capacitance comprising a pixel electrode and a common electrode, a memory circuit configured to store binary data, and a voltage selection circuit configured to supply either a first voltage or a second voltage to the pixel electrode in accordance with a value of the binary data stored in the memory circuit;

a common electrode drive circuit configured to drive the common electrode;

a state control circuit configured to switch a state of the pixel electrode between a floating state and a non-floating state;

a plurality of scanning signal lines configured to supply a scanning signal to each of the plurality of pixel circuits;

a scanning signal line drive circuit configured to apply the scanning signal to each of the plurality of scanning signal lines;

a plurality of data signal lines configured to supply a data signal to each of the plurality of pixel circuits;

a data signal line drive circuit configured to apply the data signal to each of the plurality of data signal lines;

a plurality of first voltage supply wiring lines configured to supply the first voltage to each of the plurality of pixel circuits;

a plurality of second voltage supply wiring lines configured to supply the second voltage to each of the plurality of pixel circuits;

a display voltage generation circuit configured to generate the first voltage and the second voltage;

a scanning signal supply control switch circuit provided in a region outside a display region where the plurality of pixel circuits are formed, the scanning signal supply control switch circuit being configured to control an electrical connection state between the scanning signal line drive circuit and the plurality of scanning signal lines in the display region;

a data signal supply control switch circuit provided in the region outside the display region, the data signal supply control switch circuit being configured to control an electrical connection state between the data signal line drive circuit and the plurality of data signal lines in the display region; and a display voltage supply control switch circuit provided in the region outside the display region, the display voltage supply control switch circuit being configured to control an electrical connection state between the display voltage generation circuit and the plurality of first voltage supply wiring lines in the display region and an electrical connection state between the display voltage generation circuit and the plurality of second voltage supply wiring lines in the display region, wherein the touch panel uses the common electrode as an electrode for touch detection, the common electrode drive circuit supplies a pulse signal for touch detection to the common electrode in a touch detection period for detecting a touched position on the touch panel, and the state control circuit switches the state of the pixel electrode from the non-floating state to the floating state before a start of the touch detection period, and switches the state of the pixel electrode from the floating state to the non-floating state after an end of the touch detection period, wherein the state control circuit is a switch circuit provided between the voltage selection circuit and the pixel electrode, and the switch circuit electrically disconnects the voltage selection circuit and the pixel electrode from each other before the start of the touch detection period, and electrically connects the voltage selection circuit and the pixel electrode to each other after the end of the touch detection period, and wherein the scanning signal supply control switch circuit electrically disconnects the scanning signal line drive circuit and the plurality of scanning signal lines in the display region from each other before the start of the touch detection period, and electrically connects the scanning signal line drive circuit and the plurality of scanning signal lines in the display region to each other after the end of the touch detection period, the data signal supply control switch circuit electrically disconnects the data signal line drive circuit and the plurality of data signal lines in the display region from each other before the start of the touch detection period, and electrically connects the data signal line drive circuit and the plurality of data signal lines in the display region to each other after the end of the touch detection period, and the display voltage supply control switch circuit electrically disconnects the display voltage generation circuit and the plurality of first voltage supply wiring lines in the display region from each other and electrically disconnects the display voltage generation circuit and the plurality of second voltage supply wiring lines in the display region from each other before the start of the touch detection period, and electrically connects the display voltage generation circuit and the plurality of first voltage supply wiring lines in the display region to each other and electrically connects the display voltage generation circuit and the plurality of second voltage supply wiring lines in the display region to each other after the end of the touch detection period.

2. A liquid crystal display device including a liquid crystal panel with a built-in touch panel, the liquid crystal display device comprising:

a plurality of pixel circuits each including a liquid crystal capacitance comprising a pixel electrode and a common electrode, a memory circuit configured to store binary data, and a voltage selection circuit configured to supply either a first voltage or a second voltage to the pixel electrode in accordance with a value of the binary data stored in the memory circuit;

a common electrode drive circuit configured to drive the common electrode; and a state control circuit configured to switch a state of the pixel electrode between a floating state and a non-floating state, wherein the touch panel uses the common electrode as an electrode for touch detection, the common electrode drive circuit supplies a pulse signal for touch detection to the common electrode in a touch detection period for detecting a touched position on the touch panel, and the state control circuit switches the state of the pixel electrode from the non-floating state to the floating state before a start of the touch detection period, and switches the state of the pixel electrode from the floating state to the non-floating state after an end of the touch detection period, wherein the voltage selection circuit includes a first voltage supply control switch circuit configured to control an electrical connection state between a first voltage supply wiring line configured to supply the first voltage and the pixel electrode, and a second voltage supply control switch circuit configured to control an electrical connection state between a second voltage supply wiring line configured to supply the second voltage and the pixel electrode, the first voltage supply control switch circuit electrically connects the first voltage supply wiring line and the pixel electrode to each other when a first voltage supply control signal provided from the memory circuit is at an on level, and electrically disconnects the first voltage supply wiring line and the pixel electrode from each other when the first voltage supply control signal is at an off level, the second voltage supply control switch circuit electrically connects the second voltage supply wiring line and the pixel electrode to each other when a second voltage supply control signal provided from the memory circuit is at the on level, and electrically disconnects the second voltage supply wiring line and the pixel electrode from each other when the second voltage supply control signal is at the off level, and the state control circuit is a switching circuit provided in the memory circuit and configured to switch a level of the first voltage supply control signal between the on level and the off level and switch a level of the second voltage supply control signal between the on level and the off level, the switching circuit maintaining the level of the first voltage supply control signal and the level of the second voltage supply control signal at the off level in the touch detection period.

3. The liquid crystal display device according to claim 2, the liquid crystal display device further comprising:

a plurality of scanning signal lines configured to supply a scanning signal to each of the plurality of pixel circuits;

a scanning signal line drive circuit configured to apply the scanning signal to each of the plurality of scanning signal lines;

a plurality of data signal lines configured to supply a data signal to each of the plurality of pixel circuits;

a data signal line drive circuit configured to apply the data signal to each of the plurality of data signal lines;

a display voltage generation circuit configured to generate the first voltage and the second voltage;

a scanning signal supply control switch circuit provided in a region outside a display region where the plurality of pixel circuits are formed, the scanning signal supply control switch circuit being configured to control an electrical connection state between the scanning signal line drive circuit and the plurality of scanning signal lines in the display region;

a data signal supply control switch circuit provided in the region outside the display region, the data signal supply control switch circuit being configured to control an electrical connection state between the data signal line drive circuit and the plurality of data signal lines in the display region; and a display voltage supply control switch circuit provided in the region outside the display region, the display voltage supply control switch circuit being configured to control an electrical connection state between the display voltage generation circuit and a plurality of the first voltage supply wiring lines in the display region and an electrical connection state between the display voltage generation circuit and a plurality of the second voltage supply wiring lines in the display region, wherein the scanning signal supply control switch circuit electrically disconnects the scanning signal line drive circuit and the plurality of scanning signal lines in the display region from each other before the start of the touch detection period, and electrically connects the scanning signal line drive circuit and the plurality of scanning signal lines in the display region to each other after the end of the touch detection period, the data signal supply control switch circuit electrically disconnects the data signal line drive circuit and the plurality of data signal lines in the display region from each other before the start of the touch detection period, and electrically connects the data signal line drive circuit and the plurality of data signal lines in the display region to each other after the end of the touch detection period, and the display voltage supply control switch circuit electrically disconnects the display voltage generation circuit and the plurality of the first voltage supply wiring lines in the display region from each other and electrically disconnects the display voltage generation circuit and the plurality of the second voltage supply wiring lines in the display region from each other before the start of the touch detection period, and electrically connects the display voltage generation circuit and the plurality of the first voltage supply wiring lines in the display region to each other and electrically connects the display voltage generation circuit and the plurality of the second voltage supply wiring lines in the display region to each other after the end of the touch detection period.

4. A liquid crystal display device including a liquid crystal panel with a built-in touch panel, the liquid crystal display device comprising:

a plurality of pixel circuits each including a liquid crystal capacitance comprising a pixel electrode and a common electrode, a memory circuit configured to store binary data, and a voltage selection circuit configured to supply either a first voltage or a second voltage to the pixel electrode in accordance with a value of the binary data stored in the memory circuit;

a common electrode drive circuit configured to drive the common electrode;

a state control circuit configured to switch a state of the pixel electrode between a floating state and a non-floating state;

a display voltage generation circuit provided outside the liquid crystal panel, the display voltage generation circuit being configured to generate the first voltage and the second voltage;

a first voltage supply wiring line configured to supply the first voltage from the display voltage generation circuit to the voltage selection circuit; and a second voltage supply wiring line configured to supply the second voltage from the display voltage generation circuit to the voltage selection circuit, wherein the touch panel uses the common electrode as an electrode for touch detection, the common electrode drive circuit supplies a pulse signal for touch detection to the common electrode in a touch detection period for detecting a touched position on the touch panel, and the state control circuit switches the state of the pixel electrode from the non-floating state to the floating state before a start of the touch detection period, and switches the state of the pixel electrode from the floating state to the non-floating state after an end of the touch detection period, and wherein the state control circuit is a switch circuit provided between the display voltage generation circuit and the first voltage supply wiring line and between the display voltage generation circuit and the second voltage supply wiring line, the switch circuit being configured to electrically disconnect the display voltage generation circuit and the first voltage supply wiring line from each other and electrically disconnect the display voltage generation circuit and the second voltage supply wiring line from each other before the start of the touch detection period, and electrically connect the display voltage generation circuit and the first voltage supply wiring line to each other and electrically connect the display voltage generation circuit and the second voltage supply wiring line to each other after the end of the touch detection period.

5. The liquid crystal display device according to claim 4, the liquid crystal display device further comprising:

a plurality of scanning signal lines configured to supply a scanning signal to each of the plurality of pixel circuits;

a scanning signal line drive circuit configured to apply the scanning signal to each of the plurality of scanning signal lines;

a plurality of data signal lines configured to supply a data signal to each of the plurality of pixel circuits;

a data signal line drive circuit configured to apply the data signal to each of the plurality of data signal lines;

a scanning signal supply control switch circuit provided in a region outside a display region where the plurality of pixel circuits are formed, the scanning signal supply control switch circuit being configured to control an electrical connection state between the scanning signal line drive circuit and the plurality of scanning signal lines in the display region; and a data signal supply control switch circuit provided in the region outside the display region, the data signal supply control switch circuit being configured to control an electrical connection state between the data signal line drive circuit and the plurality of data signal lines in the display region, wherein the scanning signal supply control switch circuit electrically disconnects the scanning signal line drive circuit and the plurality of scanning signal lines in the display region from each other before the start of the touch detection period and electrically connects the scanning signal line drive circuit and the plurality of scanning signal lines in the display region to each other after the end of the touch detection period, and the data signal supply control switch circuit electrically disconnects the data signal line drive circuit and the plurality of data signal lines in the display region from each other before the start of the touch detection period and electrically connects the data signal line drive circuit and the plurality of data signal lines in the display region to each other after the end of the touch detection period.

6. The liquid crystal display device according to claim 4, wherein the display voltage generation circuit and the switch circuit are provided in one integrated circuit.

* * * * *